US010870439B2

(12) United States Patent
Hashimoto et al.

(10) Patent No.: US 10,870,439 B2
(45) Date of Patent: Dec. 22, 2020

(54) VEHICLE WHEEL SUPPORT DEVICE

(71) Applicant: MITSUBISHI ELECTRIC CORPORATION, Tokyo (JP)

(72) Inventors: Michinori Hashimoto, Tokyo (JP); Hideo Terasawa, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 275 days.

(21) Appl. No.: 16/087,592

(22) PCT Filed: Mar. 29, 2016

(86) PCT No.: PCT/JP2016/060048
§ 371 (c)(1),
(2) Date: Sep. 21, 2018

(87) PCT Pub. No.: WO2017/168546
PCT Pub. Date: Oct. 5, 2017

(65) Prior Publication Data
US 2019/0084592 A1 Mar. 21, 2019

(51) Int. Cl.
*B61F 3/16* (2006.01)
*B61F 5/06* (2006.01)
*B61F 5/52* (2006.01)

(52) U.S. Cl.
CPC ..... *B61F 3/16* (2013.01); *B61F 5/06* (2013.01); *B61F 5/52* (2013.01)

(58) Field of Classification Search
CPC ..... B61F 3/16; B61F 5/06; B61F 5/52; B61F 3/08; B61F 5/148; B61F 5/26; B61F 5/50;
(Continued)

(56) References Cited

U.S. PATENT DOCUMENTS 2,477,517 A * 7/1949 Haynes ..... B61F 3/08 105/208
3,570,408 A * 3/1971 Lich ..... B61F 3/04 105/133

(Continued)

FOREIGN PATENT DOCUMENTS

JP 2000309268 A 11/2000
JP 2015100249 A 5/2015

OTHER PUBLICATIONS

International Search Report (PCT/ISA/210) dated May 17, 2016, by the Japan Patent Office as the International Searching Authority for International Application No. PCT/JP2016/060048.

(Continued)

*Primary Examiner* — Mark T Le
(74) *Attorney, Agent, or Firm* — Buchanan Ingersoll & Rooney PC

(57) ABSTRACT

Two support frames support opposite wheels rollably on a rail and support the vehicle body through suspension systems. At one end, four L-shaped links and four support links are each coupled, bilaterally symmetrically and in front of and behind the wheels, to the two support frames in a manner allowing rotation on the support frames about an axis in the front-rear direction below and above the center axis of the wheels. In a bending portion in the middle, the L-shaped links are supported by the vehicle body rotatably about an axis in the front-rear direction, and the L-shaped links and support links are coupled at the other end to each other so as to allow rotation about an axis in the front-rear direction.

20 Claims, 7 Drawing Sheets

(58) Field of Classification Search
CPC .... B61F 5/325; B61F 5/38; B61F 5/44; B61F 5/36; B61F 15/08; B61D 13/00
See application file for complete search history.

(56) References Cited

U.S. PATENT DOCUMENTS 3,661,097 A * 5/1972 Jackson ..... B61F 3/04
105/199.3
3,774,550 A * 11/1973 Lich ..... B61F 5/148
105/182.1
3,817,188 A * 6/1974 Lich ..... B61F 3/04
105/199.3
5,546,868 A * 8/1996 Sugimoto ..... B61F 7/00
105/178

OTHER PUBLICATIONS

Written Opinion (PCT/ISA/237) dated May 17, 2016, by the Japan Patent Office as the International Searching Authority for International Application No. PCT/JP2016/060048.

* cited by examiner

VEHICLE WHEEL SUPPORT DEVICE

TECHNICAL FIELD

The present disclosure relates to a vehicle wheel support device supporting a wheel for a railway vehicle and a vehicle including the vehicle wheel support device.

BACKGROUND ART

Many railway vehicles include a bogie having a structure in which: two wheels are fitted to both ends of each of two wheel shafts with the two wheels separated from each other depending on a track gauge between two rails; and the two wheel shafts with the wheels are arranged on the front side and on the rear side with respect to a direction of travel of a railway vehicle and are supported by a bogie frame. The four wheels are attached to this bogie. A railway vehicle has a configuration in which two bogies, each including two wheel shafts with wheels, are arranged on the front and rear sides of the railway vehicle, and a vehicle body is mounted on the two bogies with the vehicle body straddling the two bogies. In this case, the wheels are supported by fitting the wheels to the wheel shafts.

Recently, a lightweight low-floor vehicle is used for inner-city traffic. Due to lowering of the vehicle floor, a wheel shaft to which the right and left wheels are fixed is not used, but rather a method is used that supports the right and left wheels independently. In this structure, the right-side wheel and the left-side wheel are configured to be rotated separately from each other as the right-side wheel and the left-side wheel are not interconnected. A motor for driving the right-side wheel is different from a motor for driving the left-side wheel, and the right-side wheel and the left-side wheel are controlled separately from each other.

A conventional bogie for independent wheel drive has a structure in which wheels each of which can be individually and separately rotated are arranged on the right side and the left side of a bogie frame. Motors arranged on the right side and the left side of the bogie frame separately drive the wheels arranged on the right side and on the left side. A vehicle with such a conventional bogie can run on rails by rotational driving of the wheels.

For example, a component for independent wheel drive disclosed in Patent Literature 1 has a structure in which each of wheels can be separately rotated. In the component of Patent Literature 1, rotary speeds of motors are decreased by planetary reduction gears and torques of the motors are respectively transmitted through transmission elements to the wheels. A plurality of insertion holes is formed in each of the wheels, pin portions of the transmission elements are inserted into the insertion holes of the wheels, and ring-shaped anti-vibration elements are placed between the insertion holes and the pin portions. Torques from the motors are reliably transmitted to the wheels due to compression of the anti-vibration elements. Also, the anti-vibration elements reduce radial vibration occurring in the wheels.

CITATION LIST

Patent Literature

Patent Literature 1: Unexamined Japanese Patent Application Kokai Publication No. 2000-309268

SUMMARY OF INVENTION

Technical Problem

The bogie for independent wheel drive disclosed in Patent Literature 1 has a structure in which support of wheels is performed using shafts, each protruding outward from a bogie frame in a width direction of a vehicle body, and four wheels for the bogie are supported by the integrated bogie frame. As a result, the device disclosed in Patent Literature 1 has problems in that the bogie using the device of Patent Literature 1 has a large total mass, unsprung mass of the vehicle is hard to reduce, and there is a limitation in lowering of a vehicle body floor between the right-side and left-side wheels.

The present disclosure is made in order to solve the aforementioned problems, and thus an objective of the present disclosure is to reduce unsprung mass and to lower the vehicle body floor between wheels.

Solution to Problem

A vehicle wheel support device of the present disclosure is a vehicle wheel support device for supporting wheels of a vehicle that runs on a railroad track including two rails laid parallel to each other. The vehicle wheel support device includes a first support frame, a second support frame, first to fourth L-shaped links, first to fourth support links.

The first support frame rotatably supports a first wheel in such a manner that the first wheel can roll on one of the rails and supports a vehicle body of the vehicle through a suspension system. The second support frame rotatably supports a second wheel facing the first wheel in a lateral direction orthogonal to a traveling direction of the vehicle in such a manner that the second wheel can roll on another of the rails, is arranged separately from the first support frame and supports the vehicle body through a suspension system.

Middle bending portions of the first to fourth L-shaped links are pivotally supported by the vehicle body, and upper ends of the first to fourth L-shaped links are pivotally joined to the first to fourth support links.

Lower ends of the first and third L-shaped links are pivotally supported by a lower portion of the first support frame, and lower ends of the second and fourth L-shaped links are pivotally supported by a lower portion of the second support frame.

One ends of the first and third support links are pivotally joined to the upper ends of the first and third L-shaped links, and the other ends of the first and third support links are pivotally supported by upper portions of the second support frame. One ends of the second and fourth support links are pivotally joined to the upper ends of the second and fourth L-shaped links, and the other ends of the second and fourth support links are pivotally supported by upper portions of the first support frame.

Advantageous Effects of Invention

The vehicle wheel support device according to the present disclosure has a structure in which the support frames are directly supported by the vehicle body via a plurality of types of links so that the vehicle wheel support device does not include a bogie frame having large mass, thereby having an effect of reducing unsprung mass of the vehicle. Also, in the present disclosure, the components supporting the links are attached to the vehicle body, and thus the present disclosure has an effect of enabling lowered setting of the gap that allows relative movement between the vehicle body and the links, and enabling further lowering of the floor of the vehicle body.

DESCRIPTION OF EMBODIMENTS

Embodiments of the present disclosure are described in detail hereinafter with reference to drawings. Components that are the same or equivalent are assigned the same reference signs throughout the drawings. Also, in order to avoid complication of the figures and to facilitate understanding, there are cases in which bolts, nuts, holes through which bolts are passed, and the like are omitted from the figures.

Embodiment 1

Figure 1:
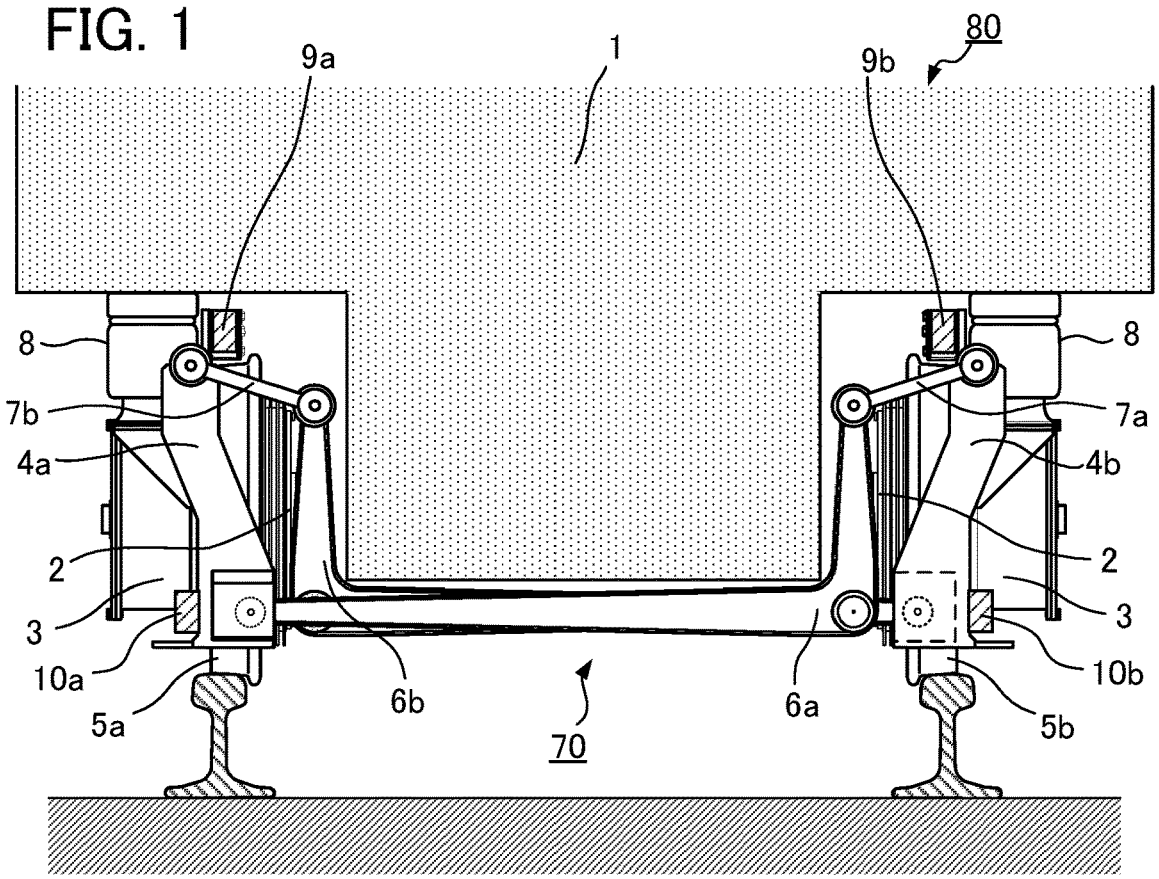
FIG. 1 is a drawing illustrating a whole structure of a vehicle wheel support device according to Embodiment 1 of the present disclosure when the vehicle wheel support device is viewed from the front side of a vehicle body of a vehicle.
Figure 2:
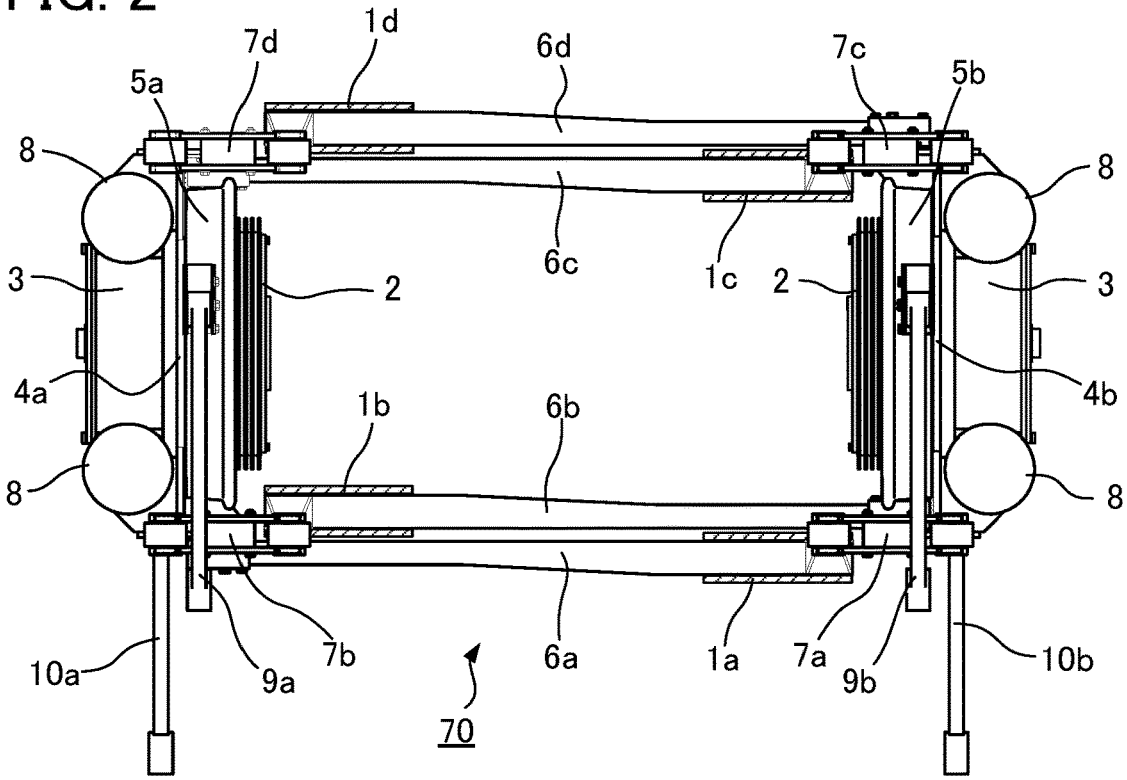
FIG. 2 is a drawing illustrating the vehicle wheel support device according to Embodiment 1 when the vehicle wheel support device is viewed from above.
Figure 3:
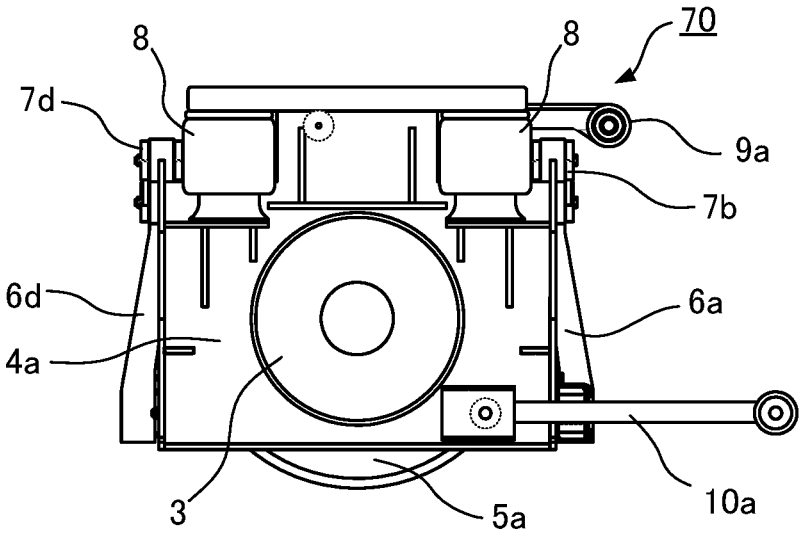
FIG. 3 is a drawing illustrating the vehicle wheel support device according to Embodiment 1 when the vehicle wheel support device is viewed from a lateral side of the vehicle.

FIG. 1 is a drawing illustrating a whole structure of a vehicle wheel support device according to Embodiment 1 of the present disclosure when the vehicle wheel support device is viewed from the front side of a vehicle body of a vehicle. FIG. 2 is a drawing illustrating the vehicle wheel support device according to Embodiment 1 when the vehicle wheel support device is viewed from above. FIG. 3 is a drawing illustrating the vehicle wheel support device according to Embodiment 1 when the vehicle wheel support device is viewed from a lateral side of the vehicle. Rails and a vehicle body 1 of a vehicle 80 are omitted from FIGS. 2 and 3.

A vehicle wheel support device 70 according to Embodiment 1 of the present disclosure is used for the vehicle running on a railroad track including two rails laid parallel to each other. In the specification, terms related to the railroad track are defined as follows: a railroad track plane is defined as a plane that touches upper surfaces of the two rails; a vertical direction is defined as a direction perpendicular to the railroad track plane; front-rear direction is defined as a direction parallel to a traveling direction of the vehicle running on the railroad track; and a lateral direction is defined as a direction parallel to the railroad track plane and orthogonal to the traveling direction of the vehicle.

The vehicle wheel support device 70 according to Embodiment 1 includes a support frame 4*a* as a first support frame and a support frame 4*b* as a second support frame, and the support frames 4*a* and 4*b* rotatably support a wheel 5*a* as a first wheel and a wheel 5*b* as a second wheel in such a manner that: the wheels 5*a* and 5*b* face each other in the lateral direction; and the wheels 5*a* can roll on one of the two rails and the wheel 5*b* can roll on the other of the two rails. Also, the support frames 4*a* and 4*b* support the vehicle body 1 of the vehicle 80 via a suspension system 8. The support frames 4*a* and 4*b* respectively support one wheel 5*a* and one wheel 5*b*, and the support frames 4*a* and 4*b* are separated from each other with respect to the lateral direction. Four sets of a L-shaped link and a linear link are used with respect to displacements of the two support frames 4*a* and 4*b* relative to the vehicle body 1 in the traverse direction of the vehicle. The vehicle wheel support device 70 transmits forces between the vehicle body 1 and the supports frames 4*a* and 4*b* using four traction links, the directions of the forces being the front-rear directions of the vehicle.

A planetary gear device 2 and a driving motor 3 are fixed to each of the support frames 4*a* and 4*b* and are coaxial with the respective wheel 5*a* or 5*b*. A rotary shaft of the driving motor 3 is joined to an input shaft of the planetary gear device 2, and an output shaft of the planetary gear device 2 is joined to the wheel 5*a* or 5*b*. The wheels 5*a* and 5*b* are rotated by driving forces of the driving motors 3.

The support frame 4*a* is arranged farther from the rail thereof than the wheel 5*a* and supports the wheel 5*a* in such a manner that the wheel 5*a* can roll on the rail thereof, and the support frame 4*b* is arranged farther from the rail thereof than the wheel 5*b* and supports the wheel 5*b* in such a manner that the wheel 5*b* can roll on the rail thereof. L-shaped links 6*a*, 6*b*, 6*c* and 6*d* are respectively supported by L-shaped link-supporting portions 1*a*, 1*b*, 1*c* and 1*d* of the vehicle body in such a manner that the L-shaped links 6*a*, 6*b*, 6*c* and 6*d* can respectively pivot about shafts that are located in respective middle bending portions of the L-shaped links 6*a*, 6*b*, 6*c* and 6*d* and that run in the front-rear direction. The L-shaped link-supporting portions 1*a*, 1*b*, 1*c* and 1*d* are omitted from FIG. 1. Lower ends of the L-shaped links 6*a*, 6*b*, 6*c* and 6*d* are pivotally joined to the support frames 4*a* and 4*b* and are positioned below central axes of the wheels 5*a* and 5*b*, and upper ends of the L-shaped links 6*a*, 6*b*, 6*c* and 6*d* are pivotally joined to ends of support links 7*a*, 7*b*, 7*c* and 7*d*. The other ends of the support links 7*a*, 7*b*, 7*c* and 7*d* are pivotally joined to the support frames 4*a* and 4*b* and are positioned above the central axes of the wheels 5*a* and 5*b*. Additionally, upper traction links 9*a* and 9*b* are pivotally joined to the support frames 4*a* and 4*b*, and lower traction links 10*a* and 10*b* are respectively pivotally joined to the support frames 4*a* and 4*b*. The vehicle wheel support device 70 is configured in the above-described manner. A structure of the vehicle wheel support device 70 for supporting the support frames 4*a* and 4*b* is described below in detail.

The L-shaped link 6*a* as a first L-shaped link is joined to the support frame 4*a* below the central axis of the wheel 5*a* and forward of the central axis of the wheel 5*a* with respect to the front-rear direction in such a manner that the L-shaped link 6*a* can pivot about a shaft running in the front-rear direction. Also, the L-shaped link 6*a* is supported by the L-shaped link-supporting portion 1*a* of the vehicle body 1 below the central axis of the wheel 5*b* and forward of the central axis of the wheel 5*b* with respect to the front-rear direction on the wheel 5*b*-side with respect to the center line between the two rails in such a manner that the L-shaped link 6*a* can pivot about a shaft running in the front-rear direction. The L-shaped link 6*b* as a second L-shaped link is joined to the support frame 4*b* below the central axis of the wheel 5*b* and forward of the central axis of the wheel 5*b* with respect to the front-rear direction in such a manner that the L-shaped link 6*b* can pivot about a shaft running in the front-rear direction. Also, the L-shaped link 6*b* is supported by the L-shaped link-supporting portion 1*b* of the vehicle body 1 below the central axis of the wheel 5*a* and forward of the central axis of the wheel 5*a* with respect to the front-rear direction on the wheel 5*a*-side with respect to the center line between the two rails in such a manner that the L-shaped link 6*b* can pivot about a shaft running in the front-rear direction. The L-shaped link 6*c* as a third L-shaped link is joined to the support frame 4*a* below the central axis of the wheel 5*a* and reward of the central axis of the wheel 5*a* with respect to the front-rear direction in such a manner that the L-shaped link 6*c* can pivot about a shaft running in the front-rear direction. Also, the L-shaped link 6*c* is supported by the L-shaped link-supporting portion 1*c* of the vehicle body 1 below the central axis of the wheel 5*b* and reward of the central axis of the wheel 5*b* with respect to the front-rear direction on the wheel 5*b*-side with respect to the center line between the two rails in such a manner that the L-shaped link 6*c* can pivot about a shaft running in the front-rear direction. The L-shaped link 6*d* as a fourth L-shaped link is joined to the support frame 4*b* below the central axis of the wheel 5*b* and reward of the central axis of the wheel 5*b* with respect to the front-rear direction in such a manner that the L-shaped link 6*d* can pivot about a shaft running in the front-rear direction. Also, the L-shaped link 6*d* is supported by the L-shaped link-supporting portion 1*d* of the vehicle body 1 below the central axis of the wheel 5*a* and reward of the central axis of the wheel 5*a* with respect to the front-rear direction on the wheel 5*a*-side with respect to the center line between the two rails in such a manner that the L-shaped link 6*d* can pivot about a shaft running in the front-rear direction.

The support link 7*a* that is a first support link extending from the support frame 4*b* toward the wheel 5*a*-side is joined, pivotally about a shaft running in the front-rear direction, to the support frame 4*b* above the central axis of the wheel 5*b* and forward of the central axis of the wheel 5*b* with respect to the front-rear direction. The support link 7*b* that is a second support link extending from the support frame 4*a* toward the wheel 5*b*-side is joined, pivotally about a shaft running in the front-rear direction, to the support frame 4*a* above the central axis of the wheel 5*a* and forward of the central axis of the wheel 5*a* with respect to the front-rear direction. The support link 7*c* that is a third support link extending from the support frame 4*b* toward the wheel 5*a*-side is joined, pivotally about a shaft running in the front-rear direction, to the support frame 4*b* above the central axis of the wheel 5*b* and reward of the central axis of the wheel 5*b* with respect to the front-rear direction. The support link 7*d* that is a fourth support link extending from the support frame 4*a* toward the wheel 5*b*-side is joined, pivotally about a shaft running in the front-rear direction, to the support frame 4*a* above the central axis of the wheel 5*a* and reward of the central axis of the wheel 5*a* with respect to the front-rear direction.

The lower traction link 10*a* that is a first lower traction link extending in the front-rear direction is joined, pivotally about a shaft running in the lateral direction, to the support frame 4*a* below the central axis of the wheel 5*a* in such a manner that the lower traction link 10*a* can pivot. Also, the lower traction link 10*a* is supported by the vehicle body 1 pivotally about a shaft running in the lateral direction. The lower traction link 10*b* that is a second lower traction link extending in the front-rear direction is joined, pivotally about a shaft running in the lateral direction, to the support frame 4*b* below the central axis of the wheel 5*b*. Also, the lower traction link 10*b* is supported by the vehicle body 1 pivotally about a shaft running in the lateral direction. The upper traction link 9*a* that is a first upper traction link extending in the front-rear direction is joined, pivotally about a shaft running in the lateral direction, to the support frame 4*a* above the central axis of the wheel 5*a*. Also, the upper traction link 9*a* is supported by the vehicle body 1 pivotally about a shaft running in the lateral direction. The upper traction link 9*b* that is a second upper traction link extending in the front-rear direction is joined, pivotally about a shaft running in the lateral direction, to the support frame 4*b* above the central axis of the wheel 5*b*. Also, the upper traction link 9*b* is supported by the vehicle body 1 pivotally about a shaft running in the lateral direction. Portions of the vehicle body 1 by which the lower traction links 10*a* and 10*b* and the upper traction links 9*a* and 9*b* are supported are not illustrated in the drawings.

The L-shaped link 6*a* is joined, pivotally about a shaft running in the front-rear direction, to the support link 7*a* above the central axis of the wheel 5*b* and forward of the central axis of the wheel 5*b* with respect to the front-rear direction. The L-shaped link 6*b* is joined, pivotally about a shaft running in the front-rear direction, to the support link 7*b* above the central axis of the wheel 5*a* and forward of the central axis of the wheel 5*a* with respect to the front-rear direction. The L-shaped link 6*c* is joined, pivotally about a shaft running in the front-rear direction, to the support link 7*c* above the central axis of the wheel 5*b* and reward of the central axis of the wheel 5*b* with respect to the front-rear direction. The L-shaped link 6*d* is joined, pivotally about a shaft running in the front-rear direction, to the support link 7*d* above the central axis of the wheel 5*a* and reward of the central axis of the wheel 5*a* with respect to the front-rear direction.

In Embodiment 1, the L-shaped links 6*a* and 6*c* are similar to each other in shape. One of the L-shaped links 6*a* and 6*c* is arranged forward of the wheels 5*a* and 5*b* and the other of the L-shaped links 6*a* and 6*c* is arranged reward of the wheels 5*a* and 5*b*. The L-shaped links 6*b* and 6*d* are similar to each other in shape. One of the L-shaped links 6*b* and 6*d* is arranged forward of the wheels 5*a* and 5*b* and the other of the L-shaped links 6*b* and 6*d* is arranged reward of the wheels 5*a* and 5*b*. Moreover, in Embodiment 1, the L-shaped links 6*a*, 6*b*, 6*c* and 6*d* are similar to one another in shape.

Figure 4:
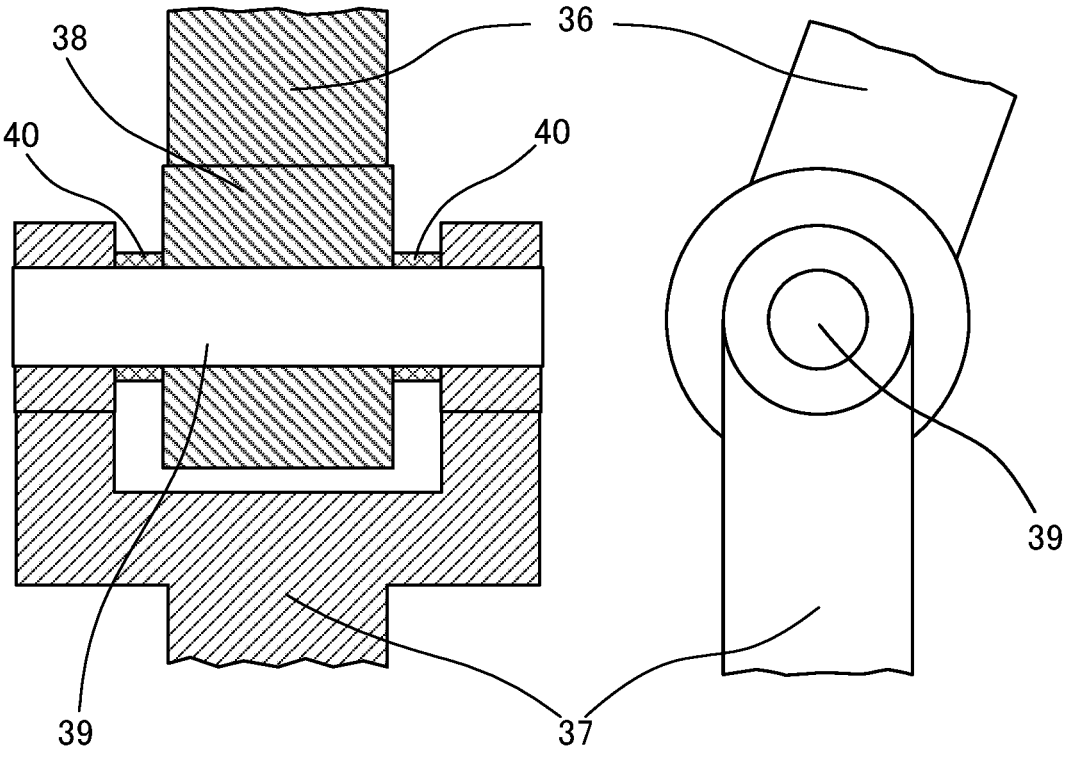
FIG. 4 is a drawing illustrating a structure for pivotally joining components to each other.

FIG. 4 is a drawing illustrating a structure for pivotally joining components to each other. As illustrated in FIG. 4, the pivot junction for pivotally joining components to each other generally has a pin joint structure in which a cylindrical pin 39 is inserted into a tubular element 38 that is arranged at an end of one link 36 playing the role of a support, the pin 39 is supported by another link 37, the tubular element 38 is kept at a fixed position in an axial direction by spacers 40, and the tubular element 38, by using a lubricant agent such as grease, can pivot about the pin 39.

Figure 5:
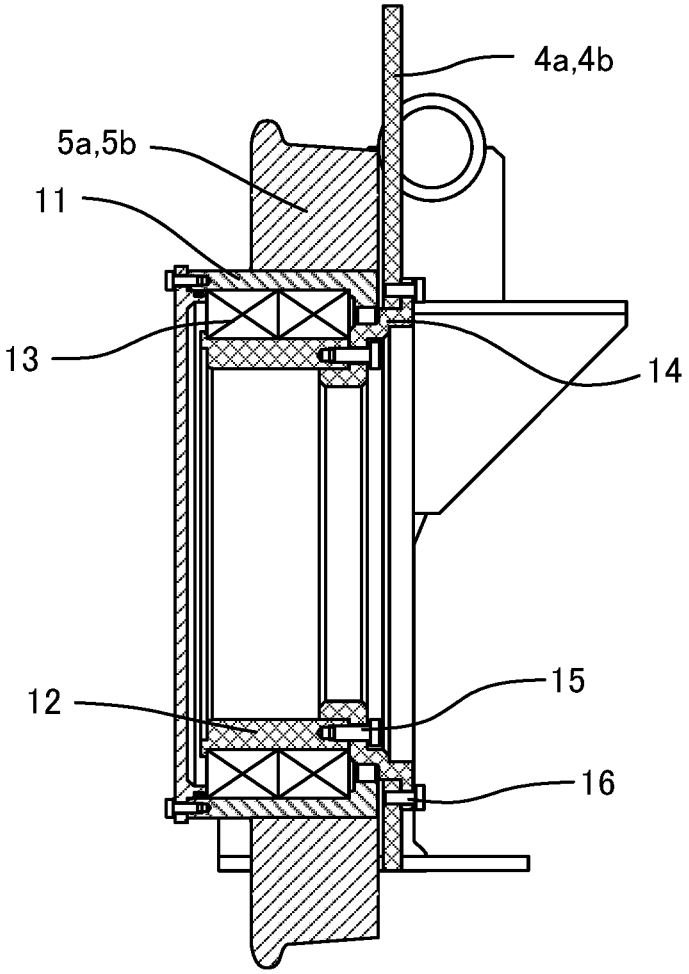
FIG. 5 is a cross-sectional view illustrating a structure for supporting wheels of the vehicle wheel support device according to Embodiment 1.

FIG. 5 is a cross-sectional view illustrating a structure for supporting wheels of the vehicle wheel support device according to Embodiment 1. The support frames 4*a* and 4*b* of the vehicle wheel support device 70 are symmetrical relative to each other. Therefore structural features of one support frame 4*a* are described below, with parentheses surrounding the reference numerals of components related to the other support frame 4*b*. FIG. 5 illustrates a structure for pivotally supporting the wheels 5*a* (5*b*) by the support frame 4*a* (4*b*). A fixing ring 14 is fixed to the support frame 4*a* (4*b*) by fastening a portion on the large-diameter side of the fixing ring 14 by fixing ring-fastening bolts 16. An inner bearing tube 12 is fixed to a portion on the small-diameter side of the fixing ring 14 by inner tube-fastening bolts 15. A bearing 13 is fitted around an outer radial periphery of the inner bearing tube 12. An outer bearing tube 11 is fitted around an outer radial periphery of the bearing 13 and the outer bearing tube 11 can rotate around the inner bearing tube 12. The wheel 5*a* (5*b*) is fitted around an outer radial periphery of the outer bearing tube 11 in such a manner that the wheel 5*a* (5*b*) cannot rotate on the outer bearing tube 11. The inner bearing tube 12, the bearing 13, the outer bearing tube 11 and the wheel 5*a* (5*b*) are concentric with one another and the wheel 5*a* (5*b*) is supported in such a manner that the wheel 5*a* (5*b*) can rotate relative to the support frame 4*a* (4*b*).

Figure 6:
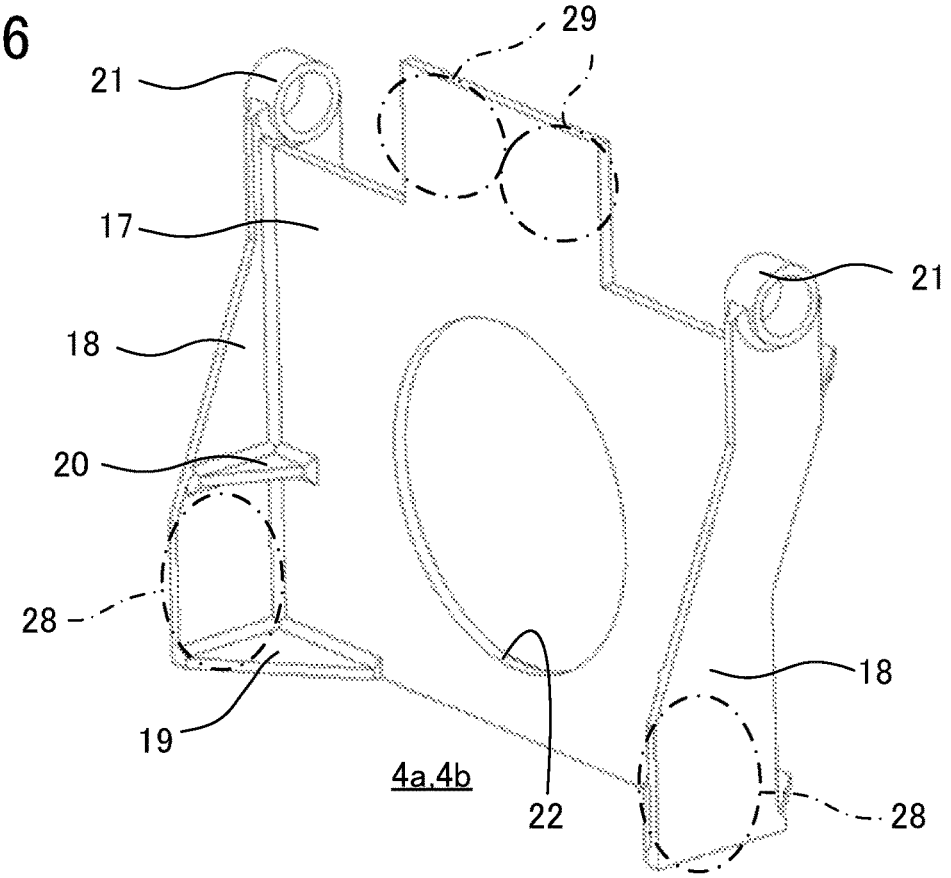
FIG. 6 is a perspective view illustrating a support frame of the vehicle wheel support device according to Embodiment 1 when the support frame is viewed from the side on which a wheel is attached.
Figure 7:
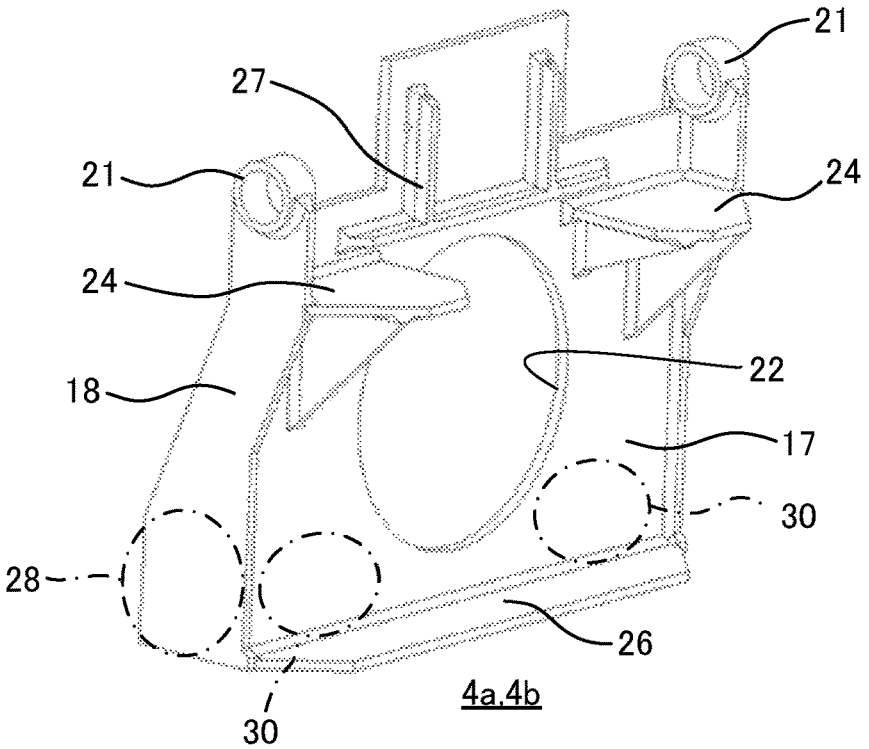
FIG. 7 is a perspective view illustrating the support frame of the vehicle wheel support device according to Embodiment 1 when the support frame is viewed from the side on which a driving motor is attached.

FIG. 6 is a perspective view illustrating a support frame of the vehicle wheel support device according to Embodiment 1 when the support frame is viewed from the side on which a wheel is attached. FIG. 7 is a perspective view illustrating the support frame of the vehicle wheel support device according to Embodiment 1 when the support frame is viewed from the side on which a driving motor is attached. The support frame 4*a* (4*b*) includes: a support frame main plate 17 for immovably supporting the planetary gear device 2 and the driving motor 3; and support frame side plates 18 that are arranged on the both sides of the support frame main plate 17, that are perpendicular to the support frame main plate 17 and that are integrated with the support frame main plate 17, and the support frame 4*a* (4*b*) is shaped like the letter "H". A fitting hole 22 enabling positioning of the fixing ring 14 is formed on the central portion of the support frame main plate 17. The fixing ring 14 illustrated in FIG. 5 is fitted into the fitting hole 22 and is fixed to the support frame 4*a* (4*b*), for example, by fastening the fixing ring 14 by the plurality of fixing ring-fastening bolts 16.

The support link 7*b* (7*a*) and the support link 7*d* (7*c*) are pivotally joined to support frame upper portion-supporting portions 21 illustrated in FIG. 6. The L-shaped link 6*a* (6*b*) and the L-shaped link 6*c* (6*d*) are pivotally joined to support frame lower portion-supporting portions 28.

The support frame 4*a* (4*b*) is subjected axially to a lateral load from the wheel 5*a* (5*b*) when the vehicle travels. Therefore, reinforcing plates 19 and 20 are fixed to a portion of the support frame 4*a* (4*b*) on the side on which the wheel 5*a* (5*b*) is attached and reinforcing plates 26 and 27 are fixed to a portion of the support frame 4*a* (4*b*) on the side on which the driving motor 3 is attached. Mounting boards 24 on which the suspension systems 8 are mounted are fixed to the support frame 4*a* (4*b*) on the side on which the driving motor 3 is attached. The vehicle body 1 is supported via the suspension systems 8 mounted on the mounting boards 24. The suspension systems 8 are, for example, air suspensions. For example, the air suspensions are fixed to the support frame 4*a* (4*b*) by passing bolts into bolt holes formed on the mounting boards 24 and by fastening the bolts from the lower side. Examples of the suspension systems 8 that can be used for the present disclosure include not only the air suspension but also a laminated leaf spring and a combination of a coil spring and a damper.

For the movement of the support frame 4*a* (4*b*) relative to the vehicle body 1 in the front-rear direction of the vehicle, the upper traction link 9*a* (9*b*) and the lower traction link 10*a* (10*b*) are each attached to the support frame 4*a* (4*b*) that is arranged in the lateral direction. One end of the upper traction link 9*a* (9*b*) is joined, pivotally about a shaft running in the lateral direction, to one of two upper traction link-supporting portions 29. The other end of the upper traction link 9*a* (9*b*) is joined, pivotally about a shaft running in the lateral direction, to the vehicle body 1. One end of the lower traction link 10*a* (10*b*) is joined, pivotally about a shaft running in the lateral direction, to one of two lower traction link-supporting portions 30 illustrated in FIG. 7. The other end of the lower traction link 10*a*, 10*b* is joined, pivotally about a shaft running in the lateral direction, to the vehicle body 1. Therefore, a traction force occurring in the wheel 5*a* (5*b*) can be transmitted to the vehicle body 1. Additionally, a braking force can be transmitted to the vehicle body 1-side when the vehicle is braked.

As illustrated in FIGS. 2 and 3, in Embodiment 1, the upper traction links 9*a* and 9*b* and the lower traction links 10*a* and 10*b* extend, in the same direction, from the shafts joined to the support frames 4*a* and 4*b*, and are pivotally joined to the vehicle body 1. Alternatively, the upper traction links 9*a* and 9*b* and the lower traction links 10*a* and 10*b* may be pivotally joined to the vehicle body 1 with the upper traction links 9*a* and 9*b* extending from the support frames 4*a* and 4*b* in one direction and with the lower traction links 10*a* and 10*b* extending from the support frames 4*a* and 4*b* in the direction opposite to the direction of the upper traction links 9*a* and 9*b* extending from the support frames 4*a* and 4*b*. As illustrated in FIGS. 6 and 7, the support frame 4*a* (4*b*) is provided with the two upper traction link-supporting portions 29 and the two lower traction-supporting links 30, and thus when the direction of a traction link joined to the vehicle body 1 is changed, the configuration of the present disclosure can be easily changed by changing a position of the traction link attached to a traction link-supporting portion.

Figure 8:
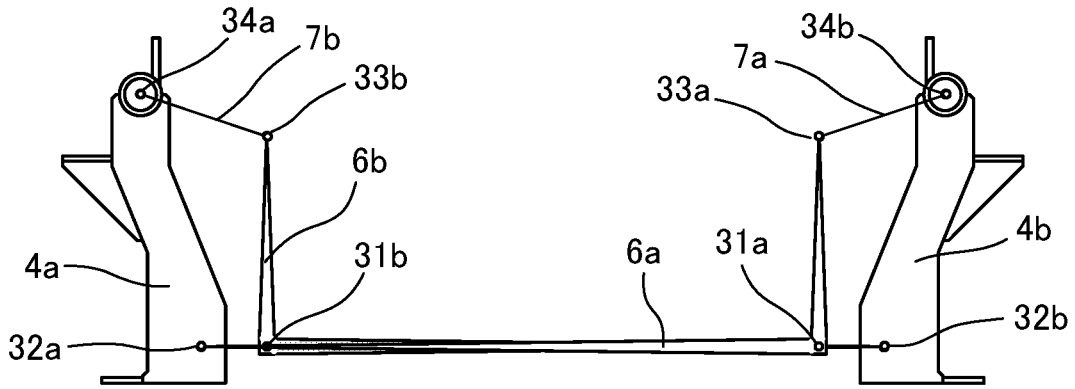
FIG. 8 is a schematic view illustrating a link mechanism of the vehicle wheel support device according to Embodiment 1.

Next, a structure for supporting the support frames 4*a* and 4*b* from the vehicle body 1-side is described. FIG. 8 is a schematic view illustrating a link mechanism of the vehicle wheel support device according to Embodiment 1. FIG. 8 schematically illustrates the relation among the support frames 4*a* and 4*b*, the L-shaped links 6*a* and 6*b* and the support links 7*a* and 7*b* that are illustrated in FIG. 1. Regarding movements of the L-shaped links and the support links in the plane orthogonal to the front-rear direction, the behavior of the L-shaped links 6*a* and 6*b* and the behavior of the support links 7*a* and 7*b* are similar to the behavior of the L-shaped links 6*c* and 6*d* and the behavior of the support links 7*c* and 7*d*.

The L-shaped links 6*a* and 6*b* are arranged between the lateral support frames 4*a* and 4*b*, and the middle bending portions of the L-shaped links 6*a* and 6*b* are provided with L-shaped link-supporting shafts 31*a* and 31*b* that are supported pivotally around axes running from the vehicle body 1 in the front-rear direction. One end of the L-shaped link 6*a* extending from the L-shaped link-supporting shaft 31*a* in the lateral direction is provided with a support frame lower portion joining shaft 32*a* that is joined, pivotally about an axis running in the front-rear direction, to the support frame lower portion-supporting portion 28 of the support frame 4*a*. One end of the L-shaped link 6*b* extending from the L-shaped link-supporting shaft 31*b* in the lateral direction is provided with a support frame lower portion joining shaft 32*b* that is joined, pivotally about an axis running in the front-rear direction, to the support frame lower portion-supporting portion 28 of the support frame 4*b*. The other end of the L-shaped link 6*a* extending from the L-shaped link-supporting shaft 31*a* in the vertical direction is provided with a link-jointing shaft 33*a* that is joined, pivotally about an axis running in the front-rear direction, to one end of the support link 7*a*. The other end of the L-shaped link 6*b* extending from the L-shaped link-supporting shaft 31*b* in the vertical direction is provided with a link-jointing shaft 33*b* that is joined, pivotally about an axis running in the front-rear direction, to one end of the support link 7*b*. The other ends of the support links 7*a* and 7*b* are respectively provided with support frame upper portion-joining shafts 34*a* and 34*b* that are respectively joined, pivotally about axes running in the front-rear direction, to the support frame upper portion-supporting portions 21 of the support frames 4*a* and 4*b*. The L-shaped link 6*a* and the support link 7*a* are joined, pivotally about an axis running in the front-rear direction, to the link-jointing shaft 33*a*. The L-shaped link 6*b* and the support link 7*b* are joined, pivotally about an axis running in the front-rear direction, to the link-jointing shaft 33*b*. As illustrated in FIG. 2, one of two sets of these L-shaped links and support links is arranged on the front side of the support frames 4*a* and 4*b* and the other of the two sets is arranged on the rear side of the support frames 4*a* and 4*b*, thereby the support frames 4*a* and 4*b* that are arranged in the lateral direction are supported by the four sets of L-shaped link and support link in the lateral direction of the vehicle body.

When the vehicle travels on a railroad track, in addition to motion of the vehicle body 1 in the front-rear direction which is caused by acceleration of or braking of the vehicle, the vehicle body 1 is also subjected to a force in the plane orthogonal to the front-rear direction, thereby causing a displacement of the vehicle body 1 relative to the wheels 5*a* and 5*b* in the plane orthogonal to the front-rear direction. An up-and-down movement of the vehicle 1 is caused by simultaneous and samely-directed bumpy movements of both the wheels 5*a* and 5*b* relative to the vehicle body 1. For example, a downward movement of the vehicle body 1 can be regarded as simultaneous upward movements of both the wheels 5*a* and 5*b* relative to the vehicle body 1. In this case, the support frame lower portion-joining shaft 32*a* of the lower end of the L-shaped link 6*a* pivotally joined to the left-side support frame 4*a* moves upward in a circular arc, the center of which is the L-shaped link-supporting shaft 31*a* of the middle bending portion of the L-shaped link 6*a*. Also, the support frame lower portion-joining shaft 32*b* of the lower end of the L-shaped link 6*b* pivotally joined to the right-side support frame 4*b* moves upward in a circular arc, the center of which is the L-shaped link-supporting shaft 31*b* of the middle bending portion of the L-shaped link 6*b*, like the support frame lower portion-joining shaft 32*a* of the lower end of the L-shaped link 6*a*.

The link-jointing shaft 33*a* of the other end of the L-shaped link 6*a* moves to the support frame 4*b*-side in a circular arc, the center of which is the L-shaped link-supporting shaft 31*a*, in response to the above movement of the support frame lower portion-joining shaft 32*a*. The link-jointing shaft 33*b* of the other end of the L-shaped link 6*b* moves to the support frame 4*a*-side in a circular arc, the center of which is the L-shaped link-supporting shaft 31*b*, in response to the above movement of the support frame lower portion-joining shaft 32*b*. The ranges of the up-and-down movements of the wheels 5*a* and 5*b* are smaller than the distance from the support frame lower portion joining shaft 32*a* to the L-shaped link-supporting shaft 31*a* in the L-shaped link 6*a* and the distance from the support frame lower portion joining shaft 32*b* to the L-shaped link-supporting shaft 31*b* in the L-shaped link 6*b*, so that amounts of the transversely horizontal movements of the support frame lower portion-joining shafts 32*a* and 32*b* caused by the up-and down movements of the wheels 5*a* and 5*b* is extremely small.

When the wheels 5*a* and 5*b* move upward relative to the vehicle body 1, the link-jointing shafts 33*a* and 33*b* of the L-shaped links 6*a* and 6*b* move to the outside as described above. The support frame upper portion-joining shafts 34*a* and 34*b* of the support frames 4*a* and 4*b* support the link-jointing shafts 33*a* and 33*b* via the support links 7*a* and 7*b* that make angles with the horizontal. Therefore, when the movements of the link-jointing shafts 33*a* and 33*b* to the outside and the upward movements of the support frame lower portion-joining shafts 32*a* and 32*b* simultaneously occur, amounts of the transversely horizontal movements of the support frame upper portion-joining shafts 34*a* and 34*b* of the support frames 4*a* and 4*b* are small. As a result, the inclinations of the support frames 4*a* and 4*b* are nearly unchanged and thus can be maintained. Due to simultaneous upward movements of the left-side and right-side wheels 5*a* and 5*b*, the railroad track plane also move parallel with the railroad track plane keeping parallel to the central axes of the wheels 5*a* and 5*b*, and the wheels 5*a* and 5*b* move up and down with rotation planes thereof maintained nearly perpendicular to the railroad track plane.

In the case where a rolling motion of the vehicle body 1 occurs, up-and-down movements of the left-side wheel 5*a* relative to the vehicle body 1 are different from up-and-down movements of the right-side wheel 5*b* relative to the vehicle body 1. For example, in the case where the vehicle body 1 pivots about the wheel 5*b* to slant to the wheel 5*a*-side, up-and-down movements of the right-side wheel 5*b* relative to the vehicle body 1 do not occur, and only the left-side wheel 5*a* can be regarded as moving upward relative to the vehicle body 1. In this case, neither the support frame lower portion-joining shaft 32*b* arranged in the lower portion of the right-side support frame 4*b* nor the link-jointing shaft 33*b* of the other end of the L-shaped link 6*b* moves.

The left-side support frame 4*a* moves upward, the support frame lower portion joining shaft 32*a* moves upward in an circular arc, the center of which is the L-shaped link-supporting shaft 31*a* of the L-shaped link 6*a*, and the link-jointing shaft 33*a* of the other end of the L-shaped link 6*a* moves to the right side. The amounts of the up-and-down movements of the support frame lower portion-joining shaft 32*a* are extremely smaller compared to the distance from the support frame lower portion-joining shaft 32*a* of the L-shaped link 6*a* to the L-shaped link-supporting shaft 31*a* of the L-shaped link 6*a*, and thus an amount of transversely horizontal movement of the support frame lower portion joining shaft 32*a* is small even though the support frame lower portion-joining shaft 32*a* moves in a circular arc. In the left-side support frame 4*a*, the support frame lower portion-joining shaft 32*a* moves nearly upward, and the inclination angle of the support link 7*b* causes the support frame upper portion-joining shaft 34*a* to pivot about the link-jointing shaft 33*b* that is immovable, thereby causing both upward and rightward movements of the support frame upper portion-joining shaft 34*a*. As a result, the support frame 4*a* inclines to the right side.

However, in the right-side support frame 4*b*, the support frame lower portion-joining shaft 32*b* arranged in the lower portion of the support frame 4*b* does not move but the link-jointing shaft 33*a* of the L-shaped link 6*a* moves to the right side. Therefore, the support frame upper portion joining shaft 34*b* of the support frame 4*b* is moved to the right side by the support link 7*a*. As a result, the support frame 4*b* also inclines to the right side. Although the up-and down movements of the right-side wheel 5*b* relative to the vehicle body 1 does not occur, the left-side wheel 5*a* moves upward, thereby the railroad track plane changes from a state in which the railroad track plane is in a horizontal position to a state in which the railroad track plane inclines to the right side, and both the left-side support frame 4*a* and the right-side support frame 4*b* incline to the right side. Therefore, also in this case, both the planes of rotation of the wheels 5*a* and 5*b* are kept nearly perpendicular to the railroad track plane.

Various movements of the vehicle body 1 including the up-and-down movements thereof and the rolling motion thereof can be expressed by the sum of the above-described simultaneous up-and-down movements of the wheels 5*a* and 5*b* and the above-described up-and-down movements of only one of the wheels 5*a* and 5*b*. As described above, both in the case of occurrence of simultaneous the up-and-down movements of the wheels 5*a* and 5*b* and in the case of occurrence of the up-and-down movements of only one of the wheels 5*a* and 5*b*, both the planes of rotation of the wheels 5*a* and 5*b* can be kept nearly perpendicular to the railroad track plane, and thus even when these movements are combined, both the planes of rotation of the wheels 5*a* and 5*b* can be kept nearly perpendicular to the railroad track plane.

Figure 9:
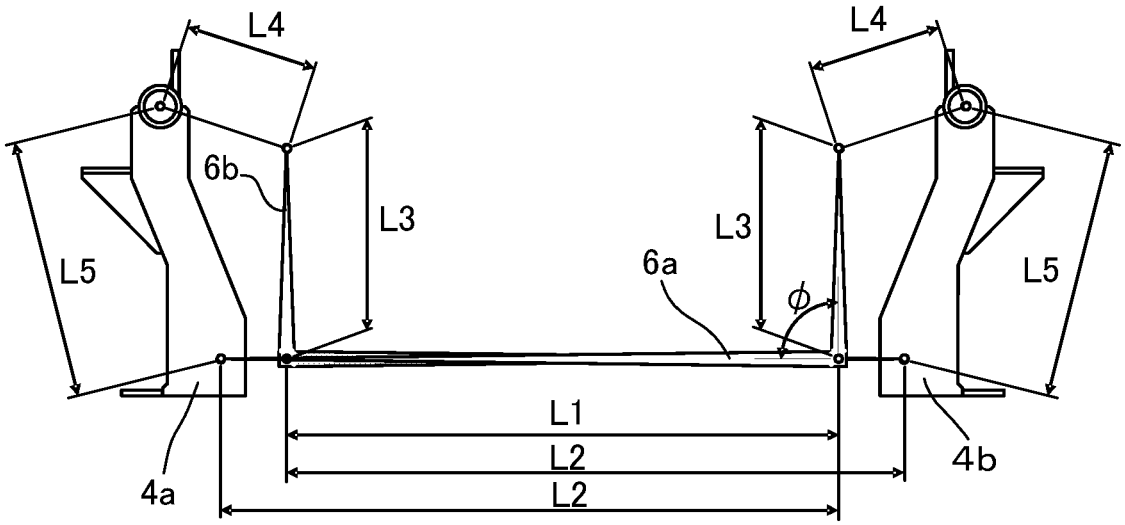
FIG. 9 is a drawing illustrating definitions of lengths of each links and a bending angle of an L-shaped link included in the link mechanism according to Embodiment 1.

As described above, the vehicle wheel support device 70 of Embodiment 1 has an effect enabling both the wheels 5*a* and 5*b* to be maintained nearly perpendicularly to the railroad track plane regardless of how the vehicle body 1 moves. However, a degree of a change in inclination angles of the wheels 5*a* and 5*b* with the railroad track plane and a degree of a change in distance between the wheels 5*a* and 5*b* vary in accordance with setting of the distance between the L-shaped link-supporting shafts 31*a* and 31*b*, the distance from the L-shaped link-supporting shaft 31*a* to the support frame lower portion-joining shaft 32*a*, the distance from the L-shaped link-supporting shaft 31*b* to the support frame lower portion joining shaft 32*b*, the distance from the L-shaped link-supporting shaft 31*a* to the link-jointing shaft 33*a*, the distance from the L-shaped link-supporting shaft 31*b* to the link-jointing shaft 33*b*, the distance from the link-jointing shaft 33*a* to the support frame upper portion-joining shaft 34*a*, the distance from the link-jointing shaft 33*b* to the support frame upper portion-joining shaft 34*b*, the distance from the support frame lower portion-joining shaft 32*a* to the support frame upper portion joining shaft 34*a*, and the distance from the support frame lower portion-joining shaft 32*b* to the support frame upper portion joining shaft 34*b*. FIG. 9 is a drawing illustrating definitions of lengths of each links and a bending angle of an L-shaped link included in the link mechanism according to Embodiment 1.

The distance between the L-shaped link-supporting shafts 31*a* and 31*b* is expressed by the symbol "L1", the distance from the L-shaped link-supporting shaft 31*a* of the L-shaped link 6*a* to the support frame lower portion-joining shaft 32*a* is expressed by the symbol "L2", the distance from the L-shaped link-supporting shaft 31*a* of the L-shaped link 6*a* to the link-jointing shaft 33*a* is expressed by the symbol "L3", the distance from the link-jointing shaft 33*a* of the support link 7*a* to the support frame upper portion-joining shaft 34*a* is expressed by the symbol "L4", the distance from the support frame lower portion-joining shaft 32*a* of the support frame 4*a* to the support frame upper portion-joining shaft 34*a* is expressed by the symbol "L5", and an angle between the shortest line segment from the support frame lower portion-joining shaft 32*a* of the L-shaped link 6*a* to the L-shaped link-supporting shaft 31*a* of the L-shaped link 6*a* and the shortest line segment from the L-shaped link-supporting shaft 31*a* of the L-shaped link 6*a* to the link-jointing shaft 33*a* of the L-shaped link 6*a* is expressed by the symbol, "φ". The distances between the corresponding pivot junction of the L-shaped links 6*b*, 6*c* and 6*d* and the angles between the shortest line segments between the corresponding pivot junction of the L-shaped links 6*b*, 6*c* and 6*d* are respectively the same as the distances between the above pivot junction of the L-shaped link 6*a* and the angle between the shortest line segments between the above pivot junction of the L-shaped link 6*a*, and the distances between the corresponding pivot junction of the support links 7*b*, 7*c* and 7*d* are the same as the distances between the above pivot junction of the support link 7*a*. Therefore, the distances between the corresponding pivot junction of the L-shaped links 6*b*, 6*c* and 6*d* and the support links 7*b*, 7*c* and 7*d* and the angles between the shortest segments between the corresponding pivot junction of the L-shaped links 6*b*, 6*c* and 6*d* are also respectively expressed by the symbols, "L1" to "L5" and "φ".

For a combination of the distances L2, L3, L4 and L5 and the angle φ when the distance L1 between the L-shaped link-supporting shafts 31*a* and 31*b* is set in accordance with a track gauge of the railroad track on which a vehicle provided with the vehicle wheel support device 70 travels, numerical calculations can be performed to calculate a change in a distance between the wheels 5*a* and 5*b* that is a wheel distance in the case where the up-and-down movements of wheels 5*a* and 5*b* in the same direction or in opposite directions occur and a change in angles with the railroad track plane which the wheels 5*a* and 5*b* make. For combinations of values obtained by varying the distances L2 to L5 and the angle φ within possible ranges of the distances L2 to L5 and the angle φ and under constraint conditions thereof, a change in distance between the wheels 5*a* and 5*b* due to up-and-down movements of the wheels 5*a* and 5*b* and a change in angles with the railroad track plane which the wheels 5*a* and 5*b* make are calculated, and the combination of values of the distances L2 to L5 and the angle φ is found for which the calculated change in distance between the wheels 5*a* and 5*b* and the calculated change in angles with the railroad track plane have the minimum values. Therefore, the vehicle wheel support device 70 can be made by forming the support frames 4*a* and 4*b*, the L-shaped links 6*a*, 6*b*, 6*c* and 6*d* and support links 7*a*, 7*b*, 7*c* and 7*d* that can achieve the set value of the wheel distance L1 and the values of the distances L2 to L5 and the angle φ at which the change in wheel distance due to up-and-down movements of the wheels 5*a* and 5*b* and the change in angles with the railroad track vehicle which the wheels 5*a* and 5*b* make have the minimum values.

The L-shaped link-supporting shafts 31*a* and 31*b* of the L-shaped links 6*a* and 6*b* are supported by the vehicle body 1 so as not to move relative to the vehicle body 1 in the vertical direction. Depending on the matter of setting the length of the L-shaped link 6*a* between the L-shaped link-supporting shaft 31*a* and the support frame lower portion-joining shaft 32*a* and the length of the L-shaped link 6*b* between the L-shaped link-supporting shaft 31*b* and the support frame lower portion joining shaft 32*b*, a vertical distance from the railroad track plane to a floor plane of the vehicle body in a low floor portion of the vehicle body between the wheels 5*a* and 5*b* is the sum of the minimum necessary vertical distance from the railroad track plane to the bottom of the vehicle body, a minimum necessary space for the L-shaped link-supporting shafts 31*a* and 31*b* of the L-shaped links 6*a* and 6*b*, and the thickness of the low floor portion of the vehicle body. Unlike conventional configurations used in the prior art, the configuration of the vehicle wheel support device 70 according to Embodiment 1 does not require any space necessary for relative up-and-down movements of the bogie frame supporting the wheels 5*a* and 5*b* relative to the vehicle body and thus makes possible achievement of a lower vertical distance between the floor plane of the vehicle body and the railroad track plane compared with vehicles using the conventional techniques.

As described above, in the vehicle wheel support device 70 according Embodiment 1, the support frames 4*a* and 4*b* rotatably supporting the wheels 5*a* and 5*b* are respectively arranged to the outside of the wheels 5*a* and 5*b*, the L-shaped links 6*a*, 6*b*, 6*c* and 6*d* are pivotally supported by the vehicle body 1 via the middle bending portions of the L-shaped links 6*a*, 6*b*, 6*c* and 6*d*, the L-shaped links 6*a*, 6*b*, 6*c* and 6*d* are pivotally joined to the support frames 4*a* and 4*b* via the support frame lower portion joining shafts 32*a* and 32*b* and to one ends of the support links 7*a*, 7*b*, 7*c* and 7*d* via the link-jointing shafts 33*a* and 33*b*. The other ends of the support links 7*a*, 7*b*, 7*c* and 7*d* are pivotally joined to the support frame upper portion-joining shafts 34*a* and 34*b* of the support frames 4*a* and 4*b*. The vehicle wheel support device 70 used for the vehicle 80 is configured by pivotally joining the upper traction link 9*a* and the lower traction links 10*a* to the support frame 4*a* and pivotally joining the upper traction link 9*b* and the lower traction links 10*b* to the support frame 4*b*. Therefore, in the vehicle wheel support device 70 according to Embodiment 1, defining distances between pivot junctions in accordance with selected values of the distance between the L-shaped link-supporting shafts 31*a* and 31*b* of the L-shaped links 6*a* and 6*b* enables a remarkable reduction in a change in distance between the wheels 5*a* and 5*b* due to up-and-down movements of the vehicle body 1 and a change in angles with the railroad track plane which the wheels 5*a* and 5*b* make. Therefore, while maintaining conditions similar to those of a generally-used railroad vehicle using the wheels integrated with the wheel shaft, upsprung mass of the vehicle can be reduced and a floor plane of the vehicle body between the wheels can be made to become close to the railroad track plane.

In FIG. 1 illustrating the vehicle wheel support device 70 according to Embodiment 1, the L-shaped link 6*a* overlaps the L-shaped link 6*c*, the L-shaped link 6*b* overlaps the L-shaped link 6*d*, the support link 7*a* overlaps the support link 7*c*, and the support link 7*b* overlaps the support link 7*d*. That is to say, in a state in which the wheels 5*a* and 5*b* are motionless on the horizontally-disposed railroad track plane, a position of a shaft of the L-shaped link 6*a* joining the L-shaped link 6*a* to the support frame 4*a* projected on a plane orthogonal to the front-rear direction matches a position of a shaft of the L-shaped link 6*c* joining the L-shaped link 6*c* to the support frame 4*a* projected on the plane orthogonal to the front-rear direction, a position of a shaft of the L-shaped link 6*b* joining the L-shaped link 6*b* to the support frame 4*b* projected on the plane orthogonal to the front-rear direction matches a position of a shaft of the L-shaped link 6*d* joining the L-shaped link 6*d* to the support frame 4*b* projected on the plane orthogonal to the front-rear direction, a position of a shaft of the L-shaped link 6*a* joining the L-shaped link 6*a* to the L-shaped link-supporting portion 1*a* projected on the plane orthogonal to the front-rear direction matches a position of a shaft of the L-shaped link 6*c* joining the L-shaped link 6*c* to the L-shaped link-supporting portion 1*c* projected on the plane orthogonal to the front-rear direction, a position of a shaft of the L-shaped link 6*b* joining the L-shaped link 6*b* to the L-shaped link-supporting portion 1*b* projected on the plane orthogonal to the front-rear direction matches a position of a shaft of the L-shaped link 6*d* joining the L-shaped link 6*d* to the L-shaped link-supporting portion 1*d* projected on the plane orthogonal to the front-rear direction, a position of the shaft of the L-shaped link 6*a* joining the L-shaped link 6*a* to the support link 7*a* projected on the plane orthogonal to the front-rear direction matches a position of a shaft of the L-shaped link 6*c* joining the L-shaped link 6*c* to the support link 7*c* projected on the plane orthogonal to the front-rear direction, a position of the shaft of the L-shaped link 6*b* joining the L-shaped link 6*b* to the support link 7*b* projected on the plane orthogonal to the front-rear direction matches a position of the shaft of the L-shaped link 6*d* joining the L-shaped link 6*d* to the support link 7*d* projected on the plane orthogonal to the front-rear direction, a position of a shaft of the support link 7*a* joining the support link 7*a* to the support frame 4*b* projected on the plane orthogonal to the front-rear direction matches a position of a shaft of the support link 7*c* joining the support link 7*c* to the support frame 4*b* and projected on the plane orthogonal to the front-rear direction, and a position of a shaft of the support link 7*b* joining the support link 7*b* to the support frame 4*a* projected on the plane orthogonal to the front-rear direction matches a position of a shaft of the support link 7*d* joining the support link 7*d* to the support frame 4*a* projected on the plane orthogonal to the front-rear direction.

Also, in FIG. 1, the L-shaped links 6*a* and 6*b* are arranged in a bilaterally symmetrical manner, the L-shaped links 6*c* and 6*d* are arranged in a bilaterally symmetrical manner, the support links 7*a* and 7*b* are arranged in a bilaterally symmetrical manner, and the support links 7*c* and 7*d* are arranged in a bilaterally symmetrical manner. That is to say, in the state in which the wheels 5*a* and 5*b* are motionless on the horizontally-disposed railroad track plane, the position of the shaft of the L-shaped link 6*a* joining the L-shaped link 6*a* to the support frame 4*a* projected on the plane orthogonal to the front-rear direction and the position of the shaft of the L-shaped link 6*b* joining the L-shaped link 6*b* to the support frame 4*b* projected on the plane orthogonal to the front-rear direction are symmetric with respect to a plane that runs along the center line between the two rails and that is perpendicular to the railroad track plane, the position of the shaft of the L-shaped link 6*a* joining the L-shaped link 6*a* to the L-shaped link-supporting portion 1*a* projected on the plane orthogonal to the front-rear direction and the position of the shaft of the L-shaped link 6*b* joining the L-shaped link 6*b* to the L-shaped link-supporting portion 1*b* projected on the plane orthogonal to the front-rear direction are symmetric with respect to the plane that runs along the center line between the two rails and that is perpendicular to the railroad track plane, the position of the shaft of the L-shaped link 6*a* joining the L-shaped link 6*a* to the support link 7*a* projected on the plane orthogonal to the front-rear direction and the position of the shaft of the L-shaped link 6*b* joining the L-shaped link 6*b* to the support link 7*b* projected on the plane orthogonal to the front-rear direction are symmetric with respect to the plane that runs along the center line between the two rails and that is perpendicular to the railroad track plane, and the position of the shaft of the support link 7*a* joining the support link 7*a* to the support frame 4*b* projected on the plane orthogonal to the front-rear direction and the position of the shaft of the support link 7*b* joining the support link 7*b* to the support frame 4*a* projected on the plane orthogonal to the front-rear direction are symmetric with respect to the plane that runs along the center line between the two rails and that is perpendicular to the railroad track plane.

In the vehicle wheel support device 70 according to Embodiment 1, as illustrated in FIGS. 1 and 2, the configuration of the L-shaped links 6*a*, 6*b*, 6*c* and 6*d* and the support links 7*a*, 7*b*, 7*c* and 7*d* has rotational symmetry with respect to an axis that passes through the central point between the wheels 5*a* and 5*b* and that is perpendicular to the railroad track plane in the state in which the wheels 5*a* and 5*b* stop on the railroad track plane that is in a horizontal state. As illustrated in FIG. 2, the configuration of the support links 7*a*, 7*b*, 7*c* and 7*d* is symmetric with respect to the plane that runs along the center line between two rails and that is perpendicular to the railroad track plane. Also, the support frame lower portion-joining shaft 32*a* of the support frame 4*a* and the support frame lower portion-joining shaft 32*b* of the support frame 4*b* are symmetric with respect to the plane that runs along the center line between the two rails and that is perpendicular to the railroad track plane.

The position of the L-shaped link 6*c* may be interchanged with the position of the L-shaped link 6*d* with respect to the front-rear direction so that configuration of the L-shaped links 6*a*, 6*b*, 6*c* and 6*d* and the support links 7*a*, 7*b*, 7*c* and 7*d* has symmetry with respect to a plane that runs along the central axes of the wheels 5*a* and 5*b* and that is orthogonal to the front-rear direction in the state in which the wheels 5*a* and 5*b* stop on the railroad track plane that is in a horizontal state.

In Embodiment 1, as illustrated in FIGS. 2 and 3, the upper traction links 9*a* and 9*b* and the lower traction links 10*a* and 10*b* are pivotally joined to the vehicle body 1 on the same side of the vehicle wheel support device 70 in the front-rear direction. Alternatively, the upper traction links 9*a* and 9*b* may be pivotally joined to the vehicle body 1 on one side of the vehicle wheel support device 70 with respect to the front-rear direction and the lower traction links 10*a* and 10*b* may be pivotally joined to the vehicle body 1 on the other side of the vehicle wheel support device 70 with respect to the front-rear direction.

In Embodiment 1, as illustrated in FIG. 2, the structures including the support frames 4*a* and 4*b*, the upper traction links 9*a* and 9*b* and the lower traction links 10*a* and 10*b* are symmetric with respect to the plane that runs along the center line between the two rails and that is perpendicular to the railroad track plane. Also, as illustrated in FIG. 3, the distance from the shaft of the upper traction link 9*a* joining the upper traction link 9*a* to the support frame 4*a* to a shaft of the upper traction link 9*a* for supporting the upper traction link 9*a* by the vehicle body is equal to the distance from the shaft of the lower traction link 10*a* joining the lower traction link 10*a* to the support frame 4*a* to a shaft of the lower traction link 10*a* for supporting the lower traction link 10*a* by the vehicle body 1, and the distance from the shaft of the upper traction link 9*b* joining the upper traction link 9*b* to the support frame 4*b* to a shaft of the upper traction link 9*b* for supporting the upper traction link 9*b* by the vehicle body 1 is equal to the distance from the shaft of the lower traction link 10*b* joining the lower traction link 10*b* to the support frame 4*b* to a shaft of the lower traction link 10*b* for supporting the lower traction link 10*b* by the vehicle body 1. Alternatively, the distance from the shaft of the upper traction link 9*a* joining the upper traction link 9*a* to the support frame 4*a* to the shaft of the upper traction link 9*a* for supporting the upper traction link 9*a* by the vehicle body 1 may be different from the shaft of the lower traction link 10*a* joining the lower traction link 10*a* to the support frame 4*a* to the shaft of the lower traction link 10*a* for supporting the lower traction link 10*a* by the vehicle body 1, and the distance from the shaft of the upper traction link 9*b* joining the upper traction link 9*b* to the support frame 4*b* to the shaft of the upper traction link 9*b* for supporting the upper traction link 9*b* by the vehicle body 1 may be different from the distance from the shaft of the lower traction link 10*b* joining the lower traction link 10*b* to the support frame 4*b* to the shaft of the lower traction link 10*b* for supporting the lower traction link 10*b* by the vehicle body 1.

Also, as illustrated in FIG. 3, the shortest line segment from the shaft of the upper traction link 9*a* joining the upper traction link 9*a* to the support frame 4*a* to the shaft of the upper traction link 9*a* for supporting the upper traction link 9*a* by the vehicle body 1 and the shortest line segment from the shaft of the upper traction link 9*b* joining the upper traction link 9*b* to the support frame 4*b* to the shaft of the upper traction link 9*b* for supporting the upper traction link 9*b* by the vehicle body 1 are parallel to the shortest segment from the shaft of the lower traction link 10*a* joining the lower traction link 10*a* to the support frame 4*a* to the shaft of the lower traction link 10*a* for supporting the lower traction link 10*a* by the vehicle body 1 and the shortest segment from the shaft of the lower traction link 10*b* joining the lower traction link 10*b* to the support frame 4*b* to the shaft of the lower traction link 10*b* for supporting the lower traction link 10*b* by the vehicle body 1. Alternatively, in the vehicle wheel support device 70 according to Embodiment 1, the upper traction links 9*a* and 9*b* and the lower traction links 10*a* and 10*b* may be arranged in such a manner that: an extended line of the shortest line segment from the shaft of the upper traction link 9*a* joining the upper traction link 9*a* to the support frame 4*a* to the shaft of the upper traction link 9*a* for supporting the upper traction link 9*a* by the vehicle body 1 and an extended line of the shortest line segment from the shaft of the upper traction link 9*b* joining the upper traction link 9*b* to the support frame 4*b* to the shaft of the upper traction link 9*b* for supporting the upper traction link 9*b* by the vehicle body 1 intersect an extended line of the shortest segment from the shaft of the lower traction link 10*a* joining the lower traction link 10*a* to the support frame 4*a* to the shaft of the lower traction link 10*a* for supporting the lower traction link 10*a* by the vehicle body 1 and an extended line of the shortest segment from the shaft of the lower traction link 10*b* joining the lower traction link 10*b* to the support frame 4*b* to the shaft of the lower traction link 10*b* for supporting the lower traction link 10*b* by the vehicle body 1; or the shortest line segment from the shaft of the upper traction link 9*a* joining the upper traction link 9*a* to the support frame 4*a* to the shaft of the upper traction link 9*a* for supporting the upper traction link 9*a* by the vehicle body 1 and the shortest line segment from the shaft of the upper traction link 9*b* joining the upper traction link 9*b* to the support frame 4*b* to the shaft of the upper traction link 9*b* for supporting the upper traction link 9*b* by the vehicle body 1 are skew to the shortest line segment from the shaft of the lower traction link 10*a* joining the lower traction link 10*a* to the support frame 4*a* to the shaft of the lower traction link 10*a* for supporting the lower traction link 10*a* by the vehicle body 1 and the shortest segment from the shaft of the lower traction link 10*b* joining the lower traction link 10*b* to the support frame 4*b* to the shaft of the lower traction link 10*b* for supporting the lower traction link 10*b* by the vehicle body 1.

Embodiment 2

Figure 10:
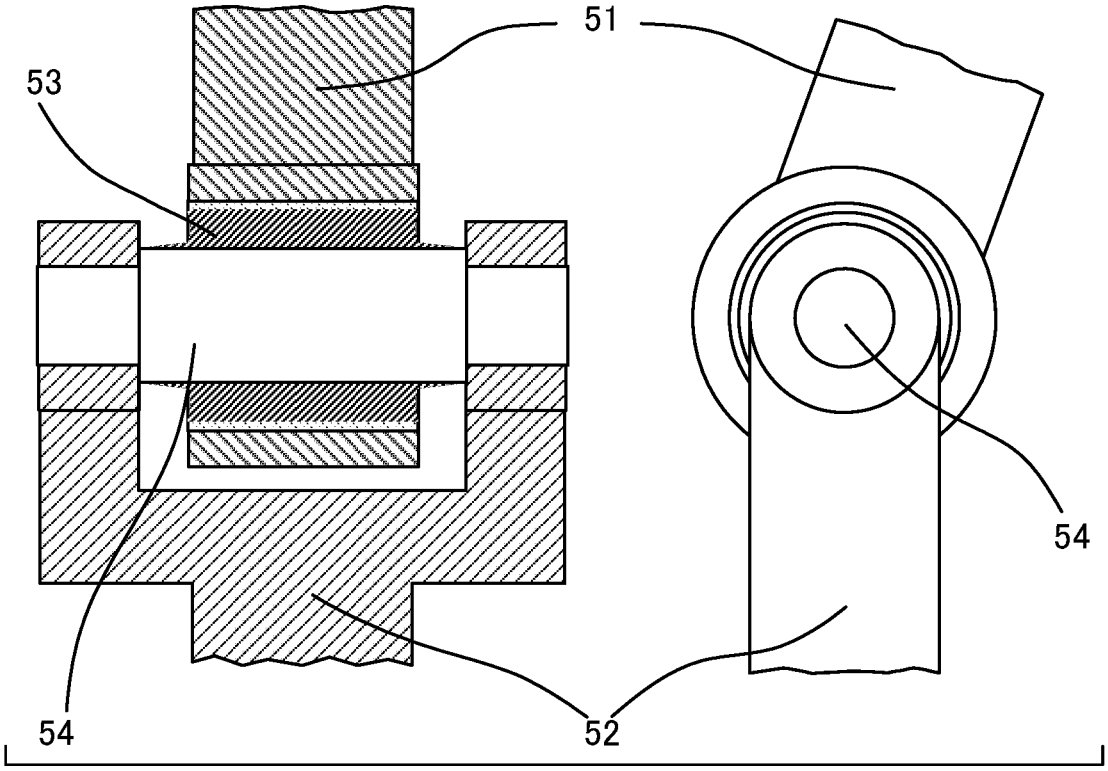
FIG. 10 is a drawing illustrating a linkage for a vehicle wheel support device according to Embodiment 2 of the present disclosure.

FIG. 10 is a drawing illustrating a linkage for a vehicle wheel support device according to Embodiment 2 of the present disclosure. In the vehicle wheel support device 70 according to Embodiment 2, each of the pivot junctions is pivotally joined using an elastic member such as a rubber bushing instead of a simple pin joint. The other structures of the vehicle wheel support device 70 according to Embodiment 2 are similar to those of the vehicle wheel support device 70 according to Embodiment 1.

As illustrated in FIG. 10, a rubber bushing 53 is fitted into a hole formed in an end of one link 51 and a rubber bushing shaft 54 penetrating through the rubber bushing 53 is supported by the other link 52, thus forming a joint portion. The link 51 denotes one of the L-shaped links 6*a*, 6*b*, 6*c* and 6*d*, and the link 52 denotes one of the support links 7*a*, 7*b*, 7*c* and 7*d*. Although FIG. 10 illustrates the joint portion between the link 51 and the link 52, the link 51 can be also joined to the support frame lower portion-joining shaft 32*a* or 32*b* or the support frame upper portion-joining shaft 34*a* or 34*b* of the support frame 4*a* or 4*b* in a manner similar to that illustrated in FIG. 10.

In the support portion illustrated in FIG. 10, the links 51 and 52 can pivot relative to each other by elastic deformation of rubber of the rubber bushing 53. Also, there is a likelihood that the links 51 and 52 incline relative to each other in addition to relative pivot of the links 51 and 52 around the shaft. Therefore, the use of the rubber bushing 53 produces an effect of allowing an axis of the end of the link 51 to incline relative to an axis of the rubber bushing shaft 54 by elastic deformation of the elastic member. Additionally, the elastic member has an effect of absorbing an impact, thus enabling anticipation of an effect that is an ability to absorb an impact force transmitted from the railroad track plane to the vehicle body 1.

Embodiment 3

Figure 11:
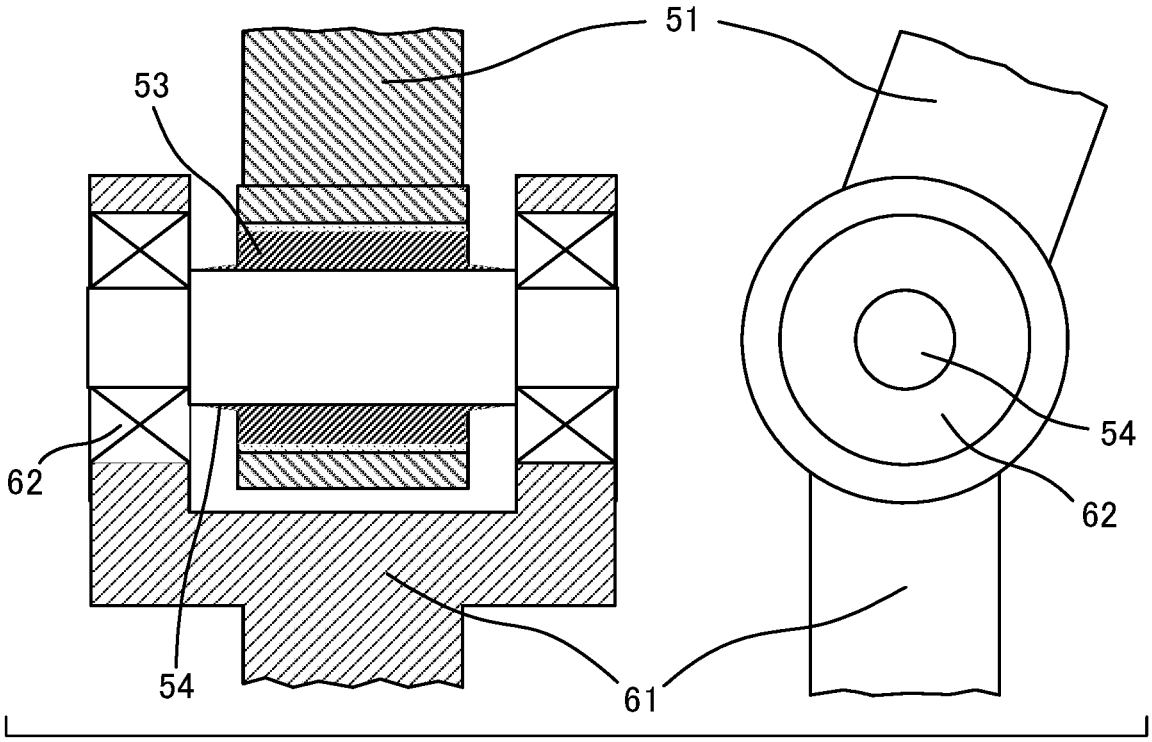
FIG. 11 is a drawing illustrating a linkage for a vehicle wheel support device according to Embodiment 3 of the present disclosure.

FIG. 11 is a drawing illustrating a linkage for a vehicle wheel support device according to Embodiment 3 of the present disclosure. In the vehicle wheel support device 70 according to Embodiment 3, each of the pivot junctions is pivotally joined using both a bearing and an elastic member such as a rubber bushing instead of a simple pin joint. The other structures of the vehicle wheel support device 70 according to Embodiment 3 are similar to those of the vehicle wheel support device 70 according to Embodiment 1.

As illustrated in FIG. 11, the rubber bushing 53 is fitted into a hole formed in an end of one link 51, the both ends of the rubber bushing shaft 54 penetrating through the rubber bushing 53 are fitted into bearings 62 and the bearings 62 are supported by an end of the other link 61, thus forming a joint portion. The link 51 denotes one of the L-shaped links 6*a*, 6*b*, 6*c* and 6*d* and the link 61 denotes one of the support links 7*a*, 7*b*, 7*c* and 7*d*. Although FIG. 11 illustrates the joint portion between the two links 51 and 61, the link 51 can be also joined to the support frame lower portion-joining shaft 32*a* or 32*b* or the support frame upper portion-joining shaft 34*a* or 34*b* of the support frame 4*a* or 4*b* in a manner similar to that illustrated in FIG. 11.

In Embodiment 3, the bearings 62 allow the links 51 and 61 to pivot relative to each other. The rubber bushing 53 enables relative inclinations of axes of the joint portions of the links 51 and 61 and absorption of an impact force transmitted from the railroad track plane to the vehicle body 1. Even if a pivot angle of the joint portion is relatively large, the bearings 62 enable problem-free pivoting. Additionally, anticipation is possible of an effect that is an ability to eliminate a repelling force occurring during pivoting and a frictional force occurring in the support portion.

Figure 12:
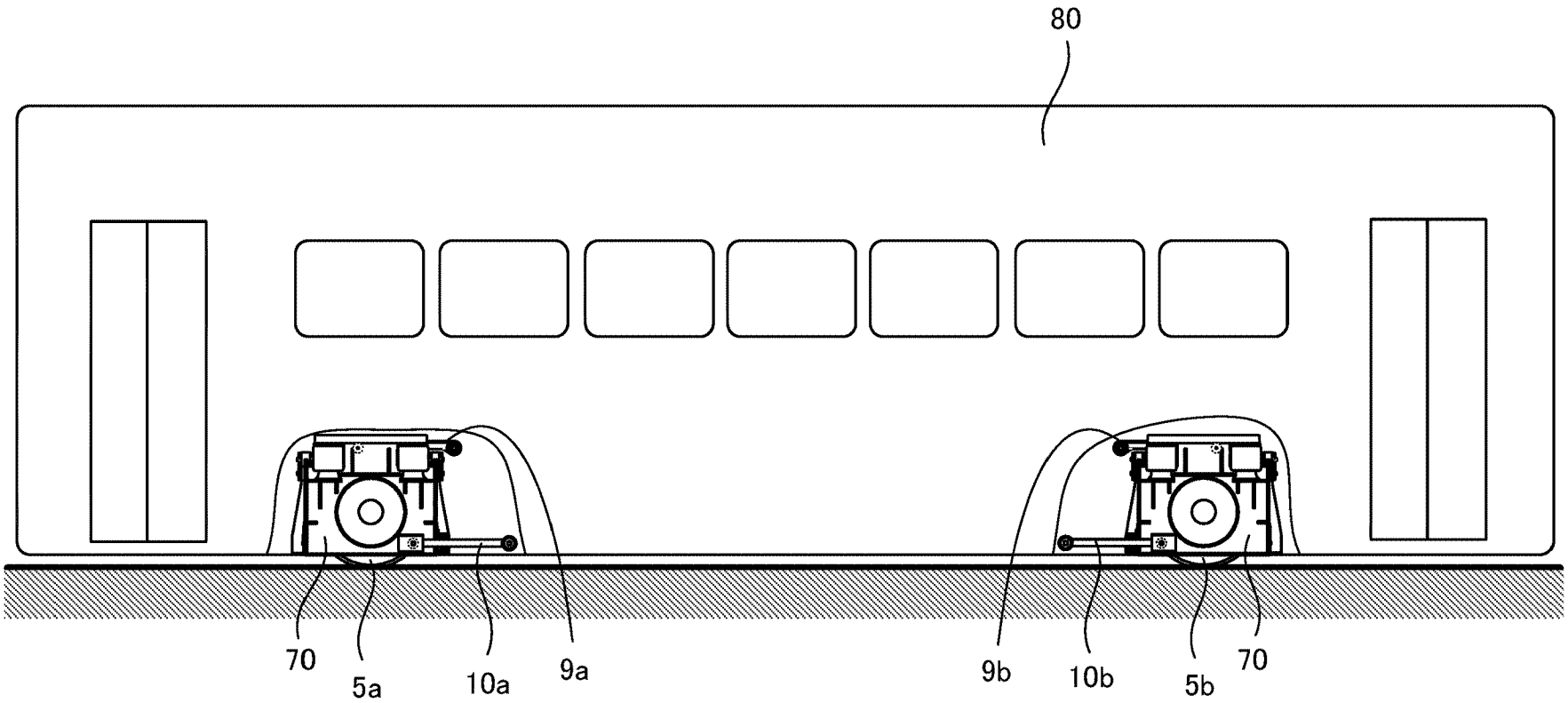
FIG. 12 is a side view illustrating a vehicle using a vehicle wheel support device according to an embodiment of the present disclosure.

FIG. 12 is a side view illustrating a vehicle using a vehicle wheel support device according to an embodiment of the present disclosure. The vehicle 80 illustrated in FIG. 12 includes two vehicle wheel support devices 70 that are illustrated in FIG. 3 and that are arranged on the front side and the rear side of the vehicle 80. In FIG. 12, the two vehicle wheel support devices 70 are arranged in such a manner that upper traction link 9*a* and the lower traction link 10*a* of one of the two vehicle wheel support devices 70 face upper traction link 9*b* and the lower traction link 10*b* of the other of the two vehicle wheel support devices 70. However, the two vehicle wheel support devices 70 may be oriented in either the frontward or backward direction. Although FIG. 12 illustrates the vehicle wheel support devices 70 illustrated in FIG. 3, the vehicle wheel support device 70 is not limited to this configuration, and a vehicle wheel support device 70 having any of the configurations described in Embodiment 1 may be used. Alternatively, a vehicle wheel support device 70 according to Embodiment 2 or 3 may be used. Also, the vehicle 80 may include a forward-arranged vehicle wheel support device 70 and a backward-arranged vehicle wheel support device 70 that are different from each other in structure.

As described above, in the vehicle wheel support device 70 according to each of the above embodiments, the support frames 4*a* and 4*b* supporting the wheels 5*a* and 5*b* in such a manner that the wheels 5*a* and 5*b* can roll on the rails are supported in such a manner that a change in distance between the wheels 5*a* and 5*b* and a change in angles with the railroad track plane which the wheels 5*a* and 5*b* make can be remarkably reduced using the L-shaped links 6*a*, 6*b*, 6*c* and 6*d* and the support links 7*a*, 7*b*, 7*c* and 7*d*. As a result, the present disclosure can, while maintaining conditions similar to generally-used wheels that are integrated with the wheel shaft, achieve a structure enabling both reduction of unsprung mass and the close proximity of a floor of a vehicle body between wheels to the railroad track plane.

The shapes of the support frames 4*a* and 4*b* are not limited to the shape of the letter "H". For example, the support frames 4*a* and 4*b* may be shaped like the letter "U" by setting of distances between joint shafts in the L-shaped links, the support links and the support frames in accordance with lengths of the L-shaped links between support points on the vehicle body side. Alternatively, although each distance between support points in each L-shaped link is defined as described above, the shapes of the L-shaped links are not limited to the shape of the letter "L", and the links may be shaped like an inverted "T".

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

INDUSTRIAL APPLICABILITY

The present disclosure is used with advantage as a structure for supporting wheels of a low-floor vehicle separately from each other.

REFERENCE SIGNS LIST

1 Vehicle body
1*a*, 1*b*, 1*c*, 1*d* L-shaped link-supporting portion
2 Planetary gear device
3 Driving motor
4*a*, 4*b* Support frame
5*a*, 5*b* Wheel
6*a*, 6*b*, 6*c*, 6*d* L-shaped link
7*a*, 7*b*, 7*c*, 7*d* Support link
8 Suspension system
9*a*, 9*b* Upper traction link
10*a*, 10*b* Lower traction link
11 Outer bearing tube
12 Inner bearing tube
13 Bearing
14 Fixing ring
15 Inner tube-fastening bolt
16 Fixing ring-fastening bolt
17 Support frame main plate
18 Support frame side plate
19 Reinforcing plate
20 Reinforcing plate
21 Support frame upper portion-supporting portion
22 Fitting hole
24 Mounting board
26 Reinforcing plate
27 Reinforcing plate
28 Support frame lower portion-supporting portion
29 Upper traction link-supporting portion
30 Lower traction link-supporting portion
31*a*, 31*b* L-shaped link-supporting shaft
32*a*, 32*b* Support frame lower portion-joining shaft
33*a*, 33*b* Link-jointing shaft
34*a*, 34*b* Support frame upper portion-joining shaft
36 Link
37 Link
38 Tubular element
39 Pin
40 Spacer
51 Link
52 Link
53 Rubber bushing
54 Rubber bushing shaft
61 Link
62 Bearing
70 Vehicle wheel support device
80 Vehicle

The invention claimed is:

1. A vehicle wheel support device for supporting wheels of a vehicle that runs on a railroad track including two rails laid parallel to each other, comprising:

a first support frame rotatably supporting a first wheel so that the first wheel can roll on one of the rails, the first support frame supporting a vehicle body of the vehicle through a suspension system;

a second support frame rotatably supporting a second wheel facing the first wheel in a lateral direction orthogonal to a traveling direction of the vehicle so that the second wheel can roll on the other of the rails, the second support frame supporting the vehicle body through a suspension system;

first to fourth L-shaped links each having a middle bending portion that is pivotally supported by the vehicle body; and first to fourth support links, one ends of which are respectively pivotally joined to upper ends of the first to fourth L-shaped links, wherein the first and third L-shaped links are disposed symmetrically in the lateral direction with respect to the second and fourth L-shaped links, the first and third L-shaped links are pivotally supported by a lower portion of the first support frame, and other ends of the first and third support links one ends of which are respectively joined to the upper ends of the first and third L-shaped links, are pivotally joined to an upper portion of the second support frame, the second and fourth L-shaped links are pivotally supported by a lower portion of the second support frame, and other ends of the second and fourth support links one ends of which are respectively joined to the upper ends of the second and fourth L-shaped links, are pivotally joined to an upper portion of the first support frame.

2. The vehicle wheel support device according to claim 1, wherein the first to fourth L-shaped links and the first to fourth support links support the first support frame and the second support frame, to enable maintenance of: (i) a transverse wheel distance between the first and second wheels, and (ii) an angle between the first wheel and a railroad track plane and an angle between the second wheel and the railroad track plane against up-and-down movements of the vehicle body and an inclination of the vehicle body in the lateral direction, the railroad track plane being a plane touching upper surfaces of the two rails.

3. The vehicle wheel support device according to claim 1, wherein the first L-shaped link, the second L-shaped link, the first support link and the second support link are arranged more forward than central axes of the first wheel and the second wheel in a front-rear direction parallel to the traveling direction of the vehicle, and the third L-shaped link, the fourth L-shaped link, the third support link and the fourth support link are arranged more backward than the central axes of the first wheel and the second wheel in the front-rear direction.

4. The vehicle wheel support device according to claim 1, wherein the first L-shaped link and the third L-shaped link are pivotally supported by the first support frame below the central axis of the first wheel, the second L-shaped link and the fourth L-shaped link are pivotally supported by the second support frame below the central axis of the second wheel, one ends of the first support link and the third support link are respectively pivotally joined to the upper ends of the first L-shaped link and the third L-shaped link, and other ends of the first support link and the third support link are pivotally supported by the second support frame above the central axis of the second wheel, and one ends of the second support link and the fourth support link are respectively pivotally joined to the upper ends of the second L-shaped link and the fourth L-shaped link, and other ends of the second support link and the fourth support link are pivotally supported by the first support frame above the central axis of the first wheel.

5. The vehicle wheel support device according to claim 1, wherein as viewed in projection on a plane orthogonal to a front-rear direction parallel to the traveling direction of the vehicle in a state in which the first wheel and the second wheel are motionless on the horizontal railroad track plane:

(a) a position of a shaft of the first L-shaped link joining the first L-shaped link to the first support frame matches a position of a shaft of the third L-shaped link joining the third L-shaped link to the first support frame, (b) position of a shaft of the second L-shaped link joining the second L-shaped link to the second support frame matches a position of a shaft of the fourth L-shaped link joining the fourth L-shaped link to the second support frame, (c) a position of a shaft of the first L-shaped link joining the first L-shaped link to the vehicle body matches a position of a shaft of the third L-shaped link joining the third L-shaped link to the vehicle body, (d) a position of a shaft of the second L-shaped link joining the second L-shaped link to the vehicle body matches a position of a shaft of the fourth L-shaped link joining the fourth L-shaped link to the vehicle body, (e) a position of a shaft of the first L-shaped link joining the first L-shaped link to the first support link matches a position of a shaft of the third L-shaped link joining the third L-shaped link to the third support link, (f) a position of a shaft of the second L-shaped link joining the second L-shaped link to the second support link matches a position of a shaft of the fourth L-shaped link joining the fourth L-shaped link to the fourth support link, (g) a position of a shaft of the first support link joining the first support link to the second support frame matches a position of a shaft of the third support link joining the third support link to the second support frame, and (h) a position of a shaft of the second support link joining the second support link to the first support frame matches a position of a shaft of the fourth support link joining the fourth support link to the first support frame.

6. The vehicle wheel support device according to claim 1, wherein as viewed in projection on the plane orthogonal to a front-rear direction parallel to the traveling direction of the vehicle in the state in which the first wheel and the second wheel are motionless on the horizontal railroad track plane:

(a) the position of the shaft of the first L-shaped link joining the first L-shaped link to the first support frame and the position of the shaft of the second L-shaped link joining the second L-shaped link to the second support frame are symmetric with respect to a plane that runs along the center line between the two rails and that is perpendicular to the railroad track plane, (b) the position of the shaft of the first L-shaped link joining the first L-shaped link to the vehicle body and the position of the shaft of the second L-shaped link joining the second L-shaped link to the vehicle body are symmetric with respect to the plane that runs along the center line between the two rails and that is perpendicular to the railroad track plane, (c) the position of the shaft of the first L-shaped link joining the first L-shaped link to the first support link and the position of the shaft of the second L-shaped link joining the second L-shaped link to the second support link are symmetric with respect to the plane that runs along the center line between the two rails and that is perpendicular to the railroad track plane, and (d) the position of the shaft of the first support link joining the first support link to the second support frame and the position of the shaft of the second support link joining the second support link to the first support frame are symmetric with respect to the plane that runs along the center line between the two rails and that is perpendicular to the railroad track plane.

7. The vehicle wheel support device according to claim 1, wherein a distance between the shaft of the first L-shaped link for supporting the first L-shaped link by the vehicle body and the shaft of the second L-shaped link for supporting the second L-shaped link by the vehicle body is defined under a given condition of a gauge distance of a track gauge of the railroad track, and a distance from the shaft of the first L-shaped link joining the first L-shaped link to the first support frame to the shaft of the first L-shaped link for supporting the first L-shaped link by the vehicle body, a distance from the shaft of the first L-shaped link for supporting the first L-shaped link by the vehicle body to the shaft of the first L-shaped link joining the first L-shaped link to the first support link, a distance from the shaft of the first L-shaped link joining the first L-shaped link to the first support link to the shaft of the first support link joining the first support link to the second support frame, a distance from the shaft of the first L-shaped link joining the first L-shaped link to the first support frame to the shaft of the second support link joining the second support link to the first support frame, and an angle between: a shortest line segment from the shaft of the first L-shaped link joining the first L-shaped link to the first support frame to the shaft of the first L-shaped link for supporting the first L-shaped link by the vehicle body; and a shortest line segment from the shaft of the first L-shaped link for supporting the first L-shaped link by the vehicle to the shaft of the first L-shaped link joining the first L-shaped link to the first support link are selected so that a combination of (a) a change in distance between the first and second wheels, (b) a change in angle between the first wheel and the railroad track plane and (c) a change in angle between the second wheel and railroad track plane due to relative movements of the first and second wheels relative to the vehicle body each of which is minimum.

8. The vehicle wheel support device according to claim 1, wherein each of the first support frame and the second support frame comprises a bearing, an inner bearing tube being fitted to an inner periphery of the bearing and fixed to each of the first support frame and the second support frame, and an outer bearing tube being fitted to an outer periphery of the bearing and fitted to each of the first wheel and the second wheel.

9. The vehicle wheel support device according to claim 1, wherein a structure comprising the first to fourth L-shaped links and the first to fourth support links has rotational symmetry with respect to an axis that passes through a central point between the first wheel and the second wheel and that is perpendicular to the railroad track plane in the state in which the first wheel and the second wheel are motionless on the railroad track plane that is in a horizontal state.

10. The vehicle wheel support device according to claim 1, wherein the first to fourth L-shaped links are pivotally joined to the first and second support frames via pin joints, the first to fourth L-shaped links are pivotally joined to the first to fourth support links via pin joints, and the first to fourth support links are pivotally joined to the first and second support frames via pin joints.

11. The vehicle wheel support device according to claim 1, wherein the first to fourth L-shaped links are joined to the first and second support frames via elastic members, the first to fourth L-shaped links are joined to the first to fourth support links via elastic members, and the first to fourth support links are joined to the first and second support frames via elastic members.

12. The vehicle wheel support device according to claim 1, wherein the first to fourth L-shaped links are joined to the first and second support frames via bearings and elastic members, the first to fourth L-shaped links are joined to the first to fourth support links via bearings and elastic members, and the first to fourth support links are joined to the first and second support frames via bearings and elastic members.

13. The vehicle wheel support device according to claim 1, further comprising:

first lower and upper traction links pivotally joined to the first support frame, extending in a front-rear direction parallel to the traveling direction of the vehicle and pivotally supported by the vehicle body; and second lower and upper traction links pivotally joined to the second support frame, extending in the front-rear direction and pivotally supported by the vehicle body.

14. The vehicle wheel support device according to claim 13, wherein the first lower traction link is pivotally joined to the first support frame below the central axis of the first wheel, the second lower traction link is pivotally joined to the second support frame below the central axis of the second wheel, the first upper traction link is pivotally joined to the first support frame above the central axis of the first wheel, and the second upper traction link is pivotally joined to the second support frame above the central axis of the second wheel.

15. The vehicle wheel support device according to claim 13, wherein the first upper traction link, the second upper traction link, the first lower traction link and the second lower traction link are pivotally supported by the vehicle body on the same side of the vehicle wheel support device in the front-rear direction.

16. The vehicle wheel support device according to claim 13, wherein the first upper traction link and the second upper traction link are pivotally joined to the vehicle body on one side of the vehicle wheel support device with respect to the front-rear direction, and the first lower traction link and the second lower traction link are pivotally joined to the vehicle body on the other side of the vehicle wheel support device with respect to the front-rear direction.

17. The vehicle wheel support device according to claim 13, wherein a distance from a shaft of the first upper traction link joining the first upper traction link to the first support frame to a shaft of the first upper traction link supporting the first upper traction link by the vehicle body, a distance from a shaft of the second upper traction link joining the second upper traction link to the second support frame to a shaft of the second upper traction link supporting the second upper traction link by the vehicle body, a distance from a shaft of the first lower traction link joining the first lower traction link to the first support frame to a shaft of the first lower traction link supporting the first lower traction link by the vehicle body, and a distance from a shaft of the second lower traction link joining the second lower traction link to the second support frame to a shaft of the second lower traction link supporting the second lower traction link by the vehicle body are equal to one another.

18. The vehicle wheel support device according to claim 13, wherein a distance from a shaft of the first upper traction link joining the first upper traction link to the first support frame to a shaft of the first upper traction link supporting the first upper traction link by the vehicle body is different from a distance from a shaft of the first lower traction link joining the first lower traction link to the first support frame to a shaft of the first lower traction link supporting the first lower traction link by the vehicle body, and a distance from a shaft of the second upper traction link joining the second upper traction link to the second support frame to a shaft of the second upper traction link supporting the second upper traction link by the vehicle body is different from a distance from a shaft of the second lower traction link joining the second lower traction link to the second support frame to a shaft of the second lower traction link supporting the second lower traction link by the vehicle body.

19. The vehicle wheel support device according to claim 13, wherein the shortest line segment from the shaft of the first upper traction link joining the first upper traction link to the first support frame to the shaft of the first upper traction link supporting the first upper traction link by the vehicle body is parallel to the shortest line segment from the shaft of the first lower traction link joining the first lower traction link to the first support frame to the shaft of the first lower traction link supporting the first lower traction link by the vehicle body, and the shortest line segment from the shaft of the second upper traction link joining the second upper traction link to the second support frame to the shaft of the second upper traction link supporting the second upper traction link by the vehicle body is parallel to the shortest line segment from the shaft of the second lower traction link joining the second lower traction link to the second support frame to the shaft of the second lower traction link supporting the second lower traction link by the vehicle body.

20. The vehicle wheel support device according to claim 13, wherein (a) the shortest line segment from the shaft of the first upper traction link joining the first upper traction link to the first support frame to the shaft of the first upper traction link joining the first upper traction link to the vehicle body and (b) the shortest line segment from the shaft of the first lower traction link joining the first lower traction link to the first support frame to the shaft of the first lower traction link joining the first lower traction link to the vehicle body are disposed such that a linear extension of the (a) shortest line segment intersects a linear extension of the (b) shortest line segment or the (a) shortest line segment is skew to the (b) shortest line segment, and (c) the shortest line segment from the shaft of the second upper traction link joining the second upper traction link to the second support frame to the shaft of the second upper traction link joining the second upper traction link to the vehicle body and (d) the shortest line segment from the shaft of the second lower traction link joining the second lower traction link to the second support frame to the shaft of the second lower traction link joining the second lower traction link to the vehicle body are disposed such that a linear extension of the (c) shortest line segment intersects a linear extension of the (d) shortest line segment or the (c) shortest line segment is skew to the (d) shortest line segment.

* * * * *